United States Patent [19]

Sheldon et al.

[11] 4,042,123

[45] Aug. 16, 1977

[54] AUTOMATED PIPE HANDLING SYSTEM

[76] Inventors: Loren B. Sheldon, 8226 Bairnsdale, Houston, Tex. 77070; James R. Tomashek, 114 E. Division St., Wooddale, Ill. 60191; Robert R. Kelly, 138 Jamison Lane, Hoffman Estates, Ill. 60172; James S. Thale, 2749 Woodbine, Evanston, Ill. 60201; Jashwant C. Shah, 923 Anderson Terrace East, Des Plaines, Ill. 60016; Donald H. Ward, 418 Ridgewood, Glen Ellyn, Ill. 60137

[21] Appl. No.: 547,375

[22] Filed: Feb. 6, 1975

[51] Int. Cl.[2] ..... E21B 19/00

[52] U.S. Cl. ..... 214/2.5; 211/60 S; 175/85

[58] Field of Search ..... 214/2.5, 1 BC, 1 BD, 214/2.5; 211/60 R, 60 S, 60 T; 175/85

[56] References Cited

U.S. PATENT DOCUMENTS

| | | | |
|---|---|---|---|
| 3,501,017 | 3/1970 | Johnson | 211/60 |
| 3,561,811 | 2/1971 | Turner | 214/2.5 X |
| 3,682,259 | 8/1972 | Cintract | 214/2.5 X |
| 3,851,769 | 12/1974 | Noguchi | 214/1 BC |
| 3,870,165 | 3/1975 | Besiun | 214/2.5 |
| 3,951,271 | 4/1976 | Mette | 214/1 BC |

*Primary Examiner*—Philip Goodman

[57] ABSTRACT

In a hydraulically powered pipe handling system, a general purpose digital computer is used to control the operation of hydraulically powered racker arms as well as the various auxiliary functions involved in vertical piperacking operations. The manual pipe-racking system (that is, that which is hydraulically powered and under the control of one or more operators) is retained, the computer controlled mode of operation being an alternative system present in the overall design.

There is provided to the operator, while the system is in its automatic mode of operation, visual indication of length of drill string, depth of hole, depth of drill bit and composition of the drill string, including number and type of pipe lengths making up the drill string.

28 Claims, 29 Drawing Figures

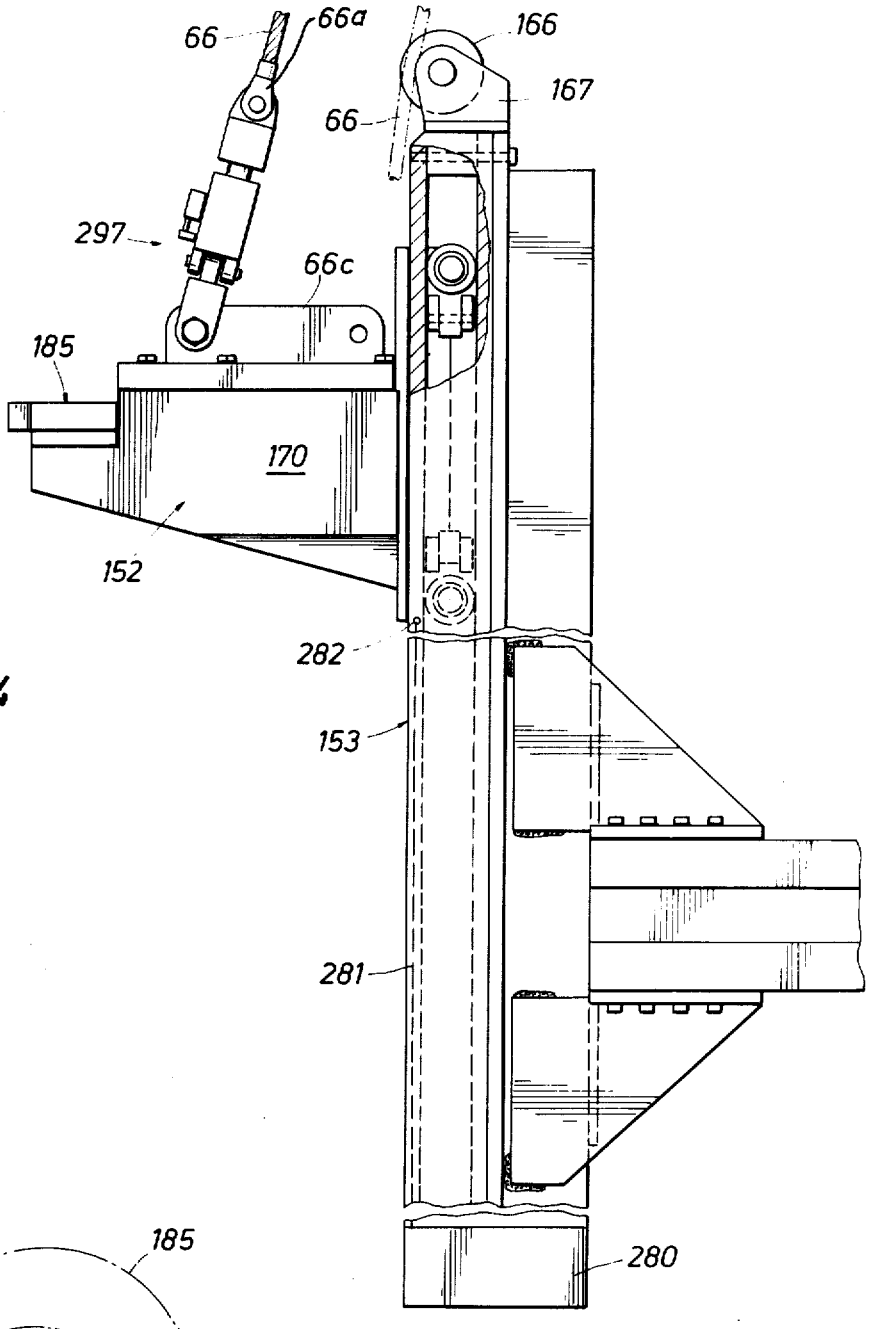
FIG. 4
FIG. 5
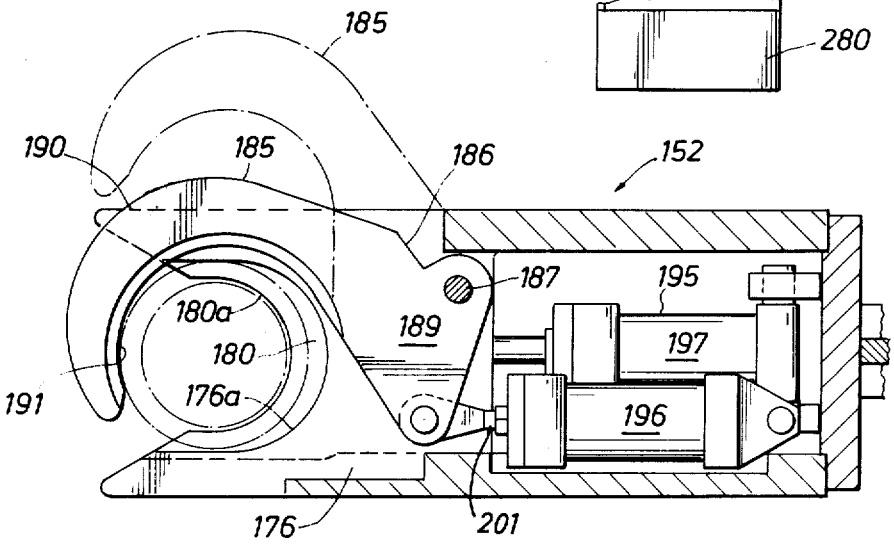

FIG. 7 (TYPICAL SEQUENCE COMING OUT OF A WELL)
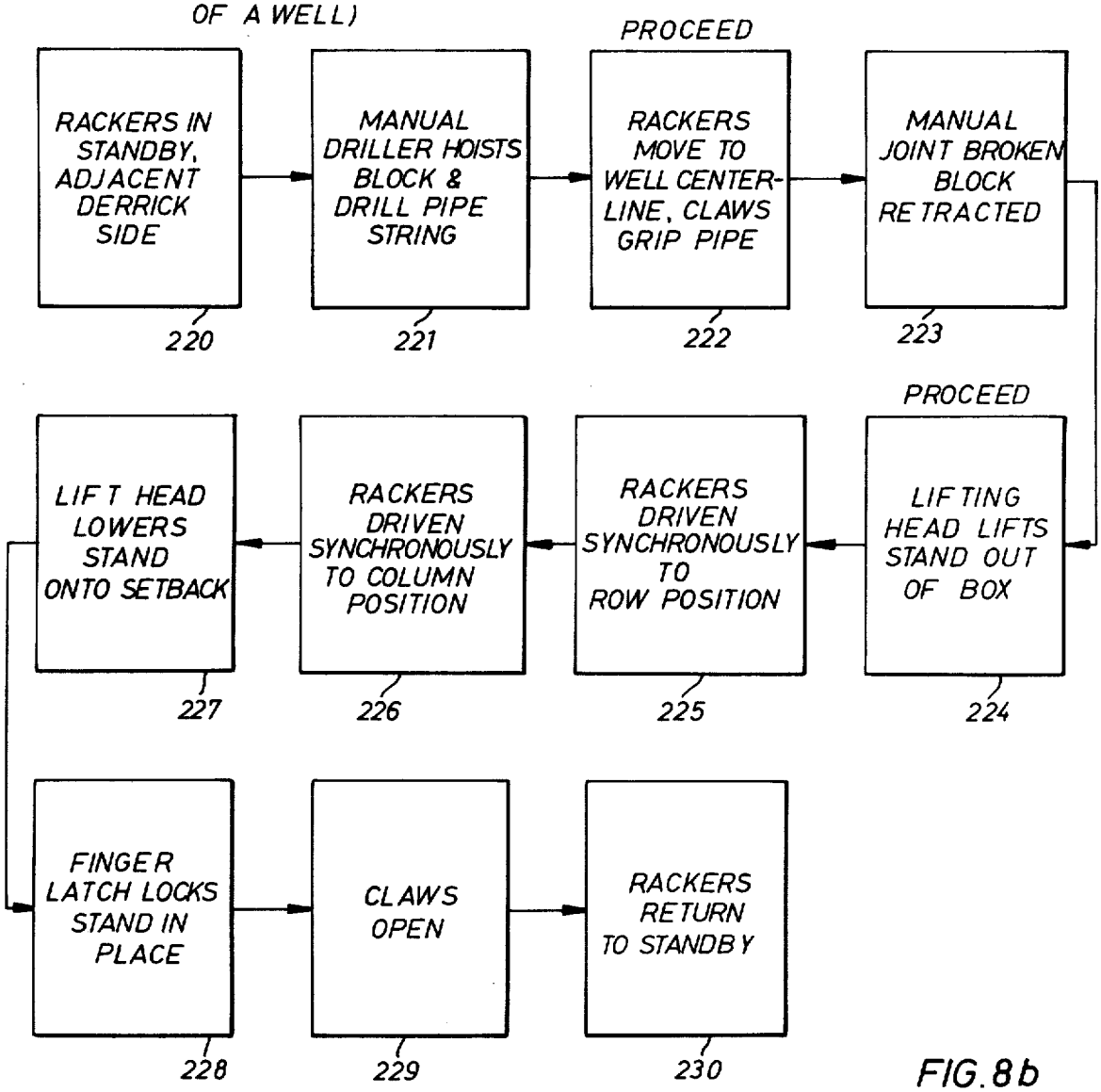
FIG. 8b
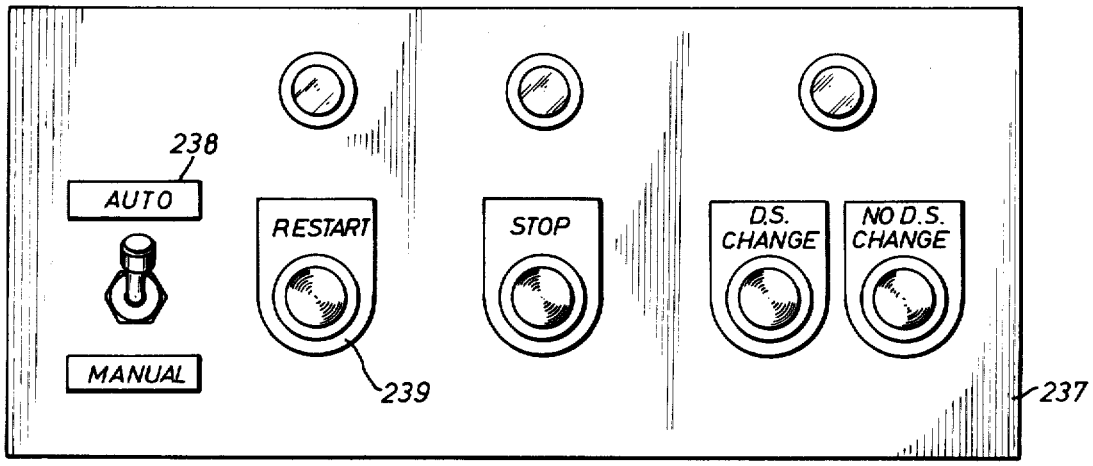

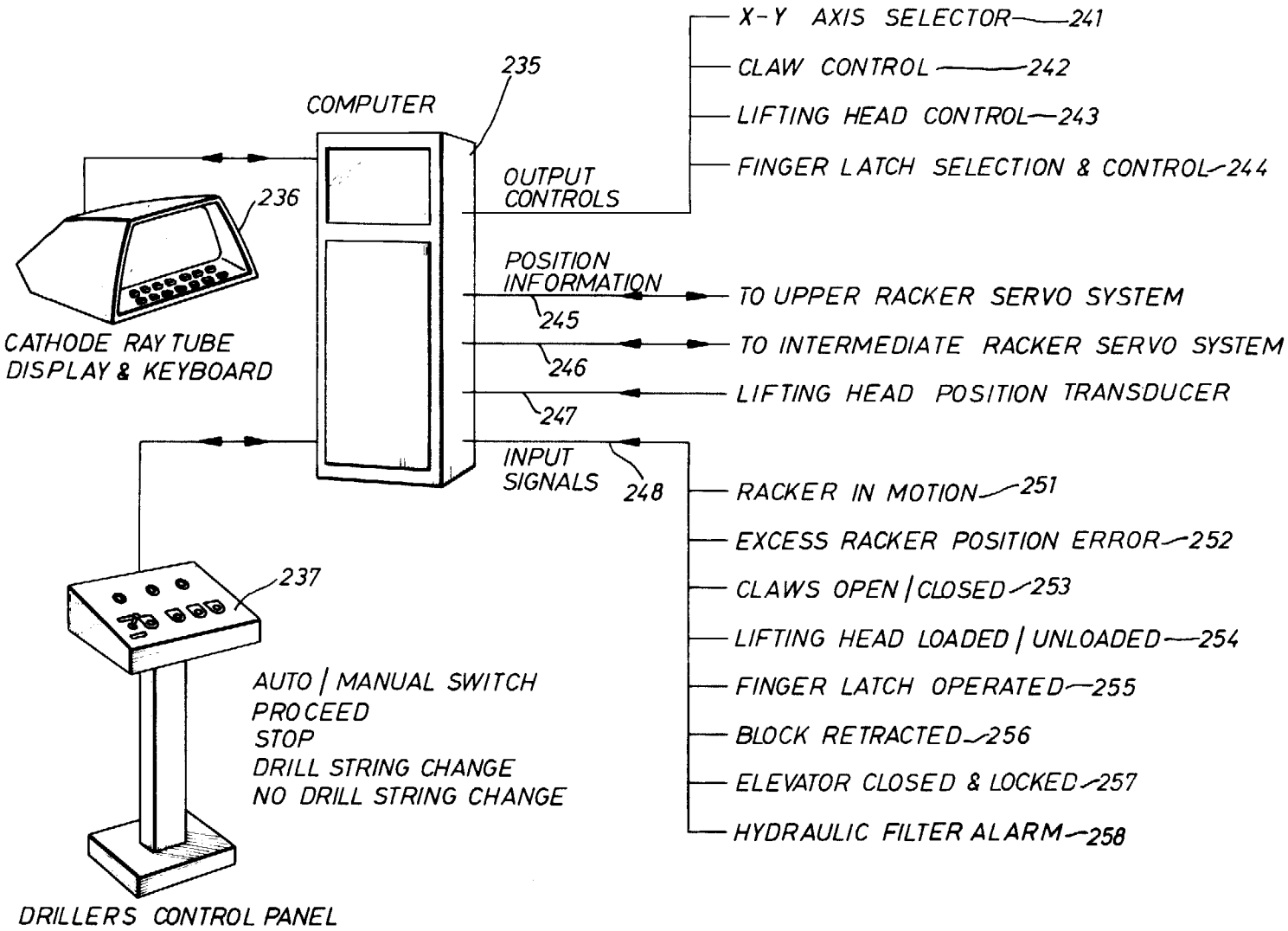
FIG. 8 (BLOCK DIAGRAM OF COMPUTER SYSTEM)

AUTOMATED PIPE HANDLING SYSTEM

BACKGROUND OF THE INVENTION

This invention is directed generally to the field of oil well drilling and equipment therefore. As more drilling activity is being undertaken in the field in remote locations, including both onshore and offshore drilling, and especially in those instances in offshore drilling where floating vessels are desirable for deep water drilling, the automation of the pipe handling apparatus becomes more desirable, both to reduce the amount of manual labor associated with handling of pipe, and to reduce the expense associated with the requirement of providing laborers. Floating vessels are inherently unstable and may have a rig or derrick constructed on a barge or ship. In derricks mounted upon a stable platform, such as an onshore drilling platform or offshore drilling platform where the platform is anchored to the earth, the automated handling of pipe is also advantageous from the standpoint of reducing the amount of physical labor required and from the standpoint of improving the safety conditions associated with the drilling of wells.

The drill pipe and drill collar handling equipment associated with this invention have been previously available. One type of such equipment is that disclosed in Turner, U.S. Pat. No. 3,561,811; and Turner, U.S. Pat. No. 3,768,663. The drill pipe and drill collar handling equipment is of the type wherein the pipe or drill collars may be positioned quickly and accurately for placing in the well hole, or may be stacked or racked in such a manner that the pipe is held in a position away from the center of the derrick in a stable condition.

In handling the pipe or drill collars, ordinarily the sections are coupled into what is termed "stands" made up of several sections or pipe lengths for handling purposes. It is customary to work a stand of three sections of pipe or drill collars, which stand must be from time to time racked in a position away from the center of the derrick so as to be out of the way of the drilling operations, but readily available to be picked up and moved to a position for connection to the drill string. Such requirements of racking the stands away from the center of the derrick and retrieving them from their racked position, for example, occurs when the drill string is being removed for changing of the drill bit, and is then reinserted into the well hole for continuation of the drilling process. Such removal and reinsertion of the drill string is commonly referred to as round tripping.

SUMMARY OF THE INVENTION

The present invention provides control apparatus for automating the operation of previously disclosed pipe racking apparatus generally disclosed in patents such as Turner, U.S. Pat. No. 3,561,811; Turner, et al, U.S. Pat. No. 3,768,663; and Ham, U.S. Pat. No. 3,615,027. The present apparatus is improved in respect of the mode of operation of the pipe rack and the pipe racker for moving pipe stands from the center of a well drilling derrick to the pipe rack at the side of the well drilling derrick for temporary storage.

The present invention more particularly provides control apparatus and operating systems for racker arms which are longitudinally extensible and retractable in vertically spaced horizontal planes and which are also laterally movable in said planes, whereby a single operator on the derrick floor may conveniently monitor the controlled movement of the vertically spaced racker arms between the pipe racking position at which a pipe is disposed above the rotary table. In addition, the control and operating systems enable the movement of the racker arms between said positions in an automated fashion, so that the operator is only required to monitor the movement of the pipe handling apparatus from the position above the rotary table to the rack adjacent the side of the derrick.

In accomplishing the foregoing, electro-hydraulic control and operating systems are employed in conjunction with a programmable digital computer and associated interfacing apparatus to automatically control the movement of individual pipe stands between the pipe rack and a position over the rotary table. This automated function includes grasping the drill string as it is lifted from the well, gripping the pipe stand to be removed from the drill string, lifting it clear of the drill string, moving the pipe stand from its position over the rotary table, moving the pipe stand to a position adjacent the racking board, moving the pipe stand into a set back position within the racking board, lowering the stand onto the set back and selectively closing a finger latch to lock the pipe into place.

The invention provides, furthermore, control and operating systems whereby actuator means under the control of an operator may be disposed in a convenient location, for example, on the derrick floor within easy reach of a floor operator.

Other objects and advantages of the invention will be hereinafter described or will become apparent to those skilled in the art, and the novel features of the invention will be defined in the appended claims.

BRIEF DESCRIPTION OF THE DRAWINGS

FIG. 4 is a side or elevational view of a lifting head.

FIG. 5 is a top view of a claw associated with the lifting head of FIG. 4.

FIG. 7 is a block diagram of the main sequenced steps associated with implementation one part of the computer control program.

FIG. 8 is a block diagram of the computer system.

FIG. 8B is a frontal view of the driller's control panel.

DESCRIPTION OF THE PREFERRED EMBODIMENT

Figure 1:
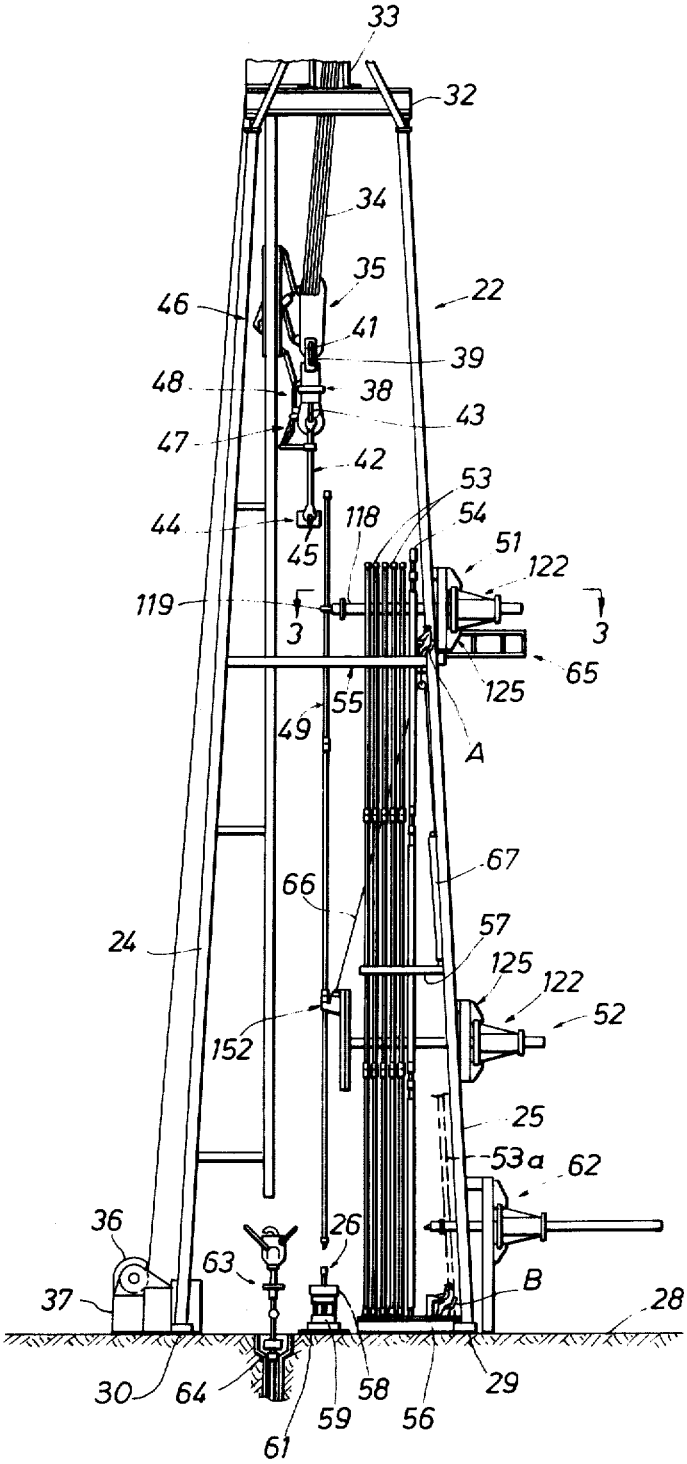
FIG. 1 is an elevational view of a well drilling derrick and associated apparatus.

Referring to FIG. 1, there is shown a drilling derrick 22, being shown somewhat schematically, with sway braces, guide wires and similar structural members being omitted to enable working apparatus to be shown more clearly. The derrick has generally vertical corner posts 24 and 25 supported on the sub base 28 on base members 29 and 30. A water table 32 near the top of the derrick 22 carries the usual crown block 33 which is aligned with the vertical center of the derrick. Suspended from the crown block by cable 34 is a traveling block 35. As is usual, one end (not shown) of the cable 34 is anchored to the structure of sub base 28 and other end is led to the spool 36 of a draw works 37 for raising and lowering the traveling blocks and the load supported thereby.

A hook structure 38 is swingably suspended from the bottom of the traveling block 35 by interengaged bales 39 on the hook end 41 of the block 35. An elevator link 42 is swingably suspended from an ear 43 on the hook structure, and the link has an elevator 44 swingably attached by another ear 45 to the lower end of the link 42. A second elevator link (not shown in FIG. 2) on the other side of the hook structure 38 similarly connects the elevator 44 to the hook structure 38. The general reference numeral 46 denotes apparatus for positioning and guiding the block and hook structure. An elevator link stabilizing device is designated by the general reference number 47. The general reference number 48 designates apparatus for supplying compressed air to the elevator 44 to actuate it. The general reference numbers 51, 52 and 62 designate apparatus for pipe racking, the numbers being directed to an upper carriage and arm assembly 51, intermediate carriage and arm assembly 52 with a lifting head 152, and a lower arm and carriage assembly 62. The details of the block-and-hook-stabilizing-and-a-positioning means 46, the link stabilizing means 47, the means 48 for supplying air to elevator 44, and the pipe racking control system designated at 51, 52 and 62 are more particularly disclosed in Letters Patent as follows:

Jones and Turner, Jr.- Block and Hook Structure Positioning and Guiding Apparatus, U. S. Pat. No. 3,507,405;

Langowski and Turner, Jr. - Link Stabilizer for Well Drilling Rigs, U.S. Pat. No. 3,526,425;

McFadden - Fluid conductor Means for Hook Mounted Elevator, U.S. Pat. No. 3,479,062;

Turner, Jr. - Stabilized Pipe Supporting Structure for Drilling Rigs, U.S. Pat. No. 3,498,586; and Ham, J. E. - Pipe Racking Control System, U.S. Pat. No. 3,615,027.

A stand 49 of drill pipe, composed in this instance of three individual pipe lengths, is shown as being supported by pipe-handling equipment including an upper racker assembly 51 and an intermediate pipe supporting racker assembly 52, which will be hereinafter described. Other stands 53 of drill pipe or drill collars 54 are shown at rest in a pipe rack having a finger board 55, a base or setback 56, and an intermediate rack member 57. The upper end of the string of drill pipe 26 is shown projecting above the power tongs 58, the slips 59, and the rotary table 61. Casing manipulating apparatus is shown at 62, also referred to as the lower carriage and arm assembly. A swivel and kelley assembly 63 is disposed in the rat hole 64. The racker assemblies are more particularly illustrated and described in U.S. Pat. No. 3,561,881, Turner.

Projecting outwardly from the derrick and positioned under the racker 51 is a horizontal stage 65 upon which an operator may stand to adjust or repair the racker.

Associated with the racker 52 is a cable 66 actuated by a fluid-powered piston-and-cylinder motor 67 for raising and lowering the lifting head, as is more particularly described in U.S. Pat. No. 3,615,027. Associated with the cylinder motor 67 is lifting cable 66 which is connected to a lifting head 152 of racker 52 for raising and lowering the pipe stand 49.

Figure 3:
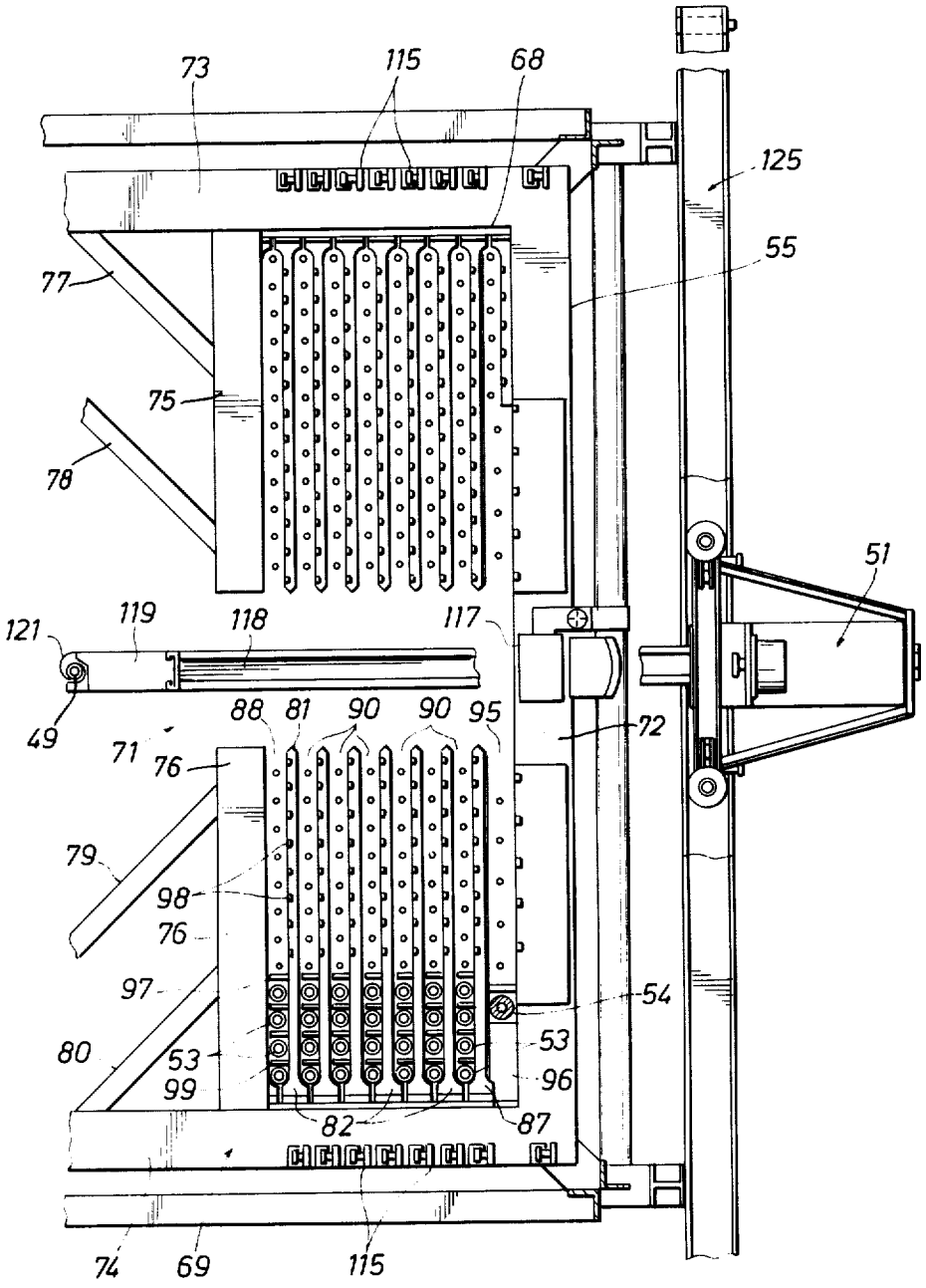
FIG. 3 is a top view of the rack and finger board assembly.

Referring next to FIG. 3, the finger board assembly 55 as shown as being in two sections; one, 68, located on the right-hand side as viewed from the derrickman's vantage point, and the other, 69, located on the left-hand side of a central opening 71. It is noted that this finger board assembly 55 may be positioned at a considerable height in the derrick 22, for example, approximately 80 feet above platform 28.

The finger board assembly 55 has what may be termed a rear rail 72 extending across the side of the finger board adjacent the derrick 22. Extending across the outer or closed side of the right-hand finger board section 68 is what may be termed the end rail 73, and extending across the left-hand outer end of the finger board section 69 is what may be termed the end rail 74. Extending inwardly from the end rails 73 and 74 are the front rails 75 and 76, respectively. The rails 72, 73, 74, 75 and 76 comprise the framework for supporting the finger board sections, and may be referred to as a walk-around. The front rails 75 and 76 have braces, 77, 78, 79 and 80.

Mounted on the end rails 74 are the drill pipe fingers 82 and one or more drill collar fingers 87. These fingers are mounted on their left-hand ends to extend horizontally across the derrick, and are spaced apart laterally from the front rail 76 to the drill collar finger 87 a distance sufficient to accommodate the size of drill pipe to be racked therein. The finger 87 is spaced from the rear rail 72 a distance to accomodate the diameter of the drill collar to be racked therein. The space between the front rail 76 and the finger 81 is shown at 88. This space extends from the outer end of the finger to the base of the finger near the rail 74 and has sufficient horizontal depth to accommodate a selected number of stands of pipe, in the illustration here shown as 12. The same holds true in respect to the spaces 90. The space 95 between the drill collar finger 87 and the rear rail 72 is greater than that between the other fingers, but the depth of the space is shown as being such that it will accommodate six stands of drill collars. The left-hand end of the space is shown as being closed by gusset 96 which is preferably attached between the rear rail 72 and the drill collar finger 87 and extends horizontally outward a distance to provide a support and reinforcement for the assembly and a stop for the first drill collar stand 54 racked therein.

Each of the fingers 82 and 87 has a series of spaced latches 97 spaced apart a sufficient distance to accomodate the diameter of a drill pipe, and extending from end to end of the fingers, there being shown in the illustration 12 such latches for each finger. The latches are indicated in their open or raised position at 98, for example, and in the closed position at 99. In the open position, pipe may be moved freely into and out of the openings between the fingers.

A right-hand racking board section 73 is provided with the drill pipe fingers and with a drill collar finger, the arrangement of which fingers are identical with the fingers above described, and function the same way. These various latches associated with the finger board assembly 55 are germane to the present invention only to the extent that they are an element of the automated pipe handling system, with their structure and mode of operation being described in detail in U.S. Pat. No. 3,768,663, Control for Well Pipe Racks and the Like. The hydraulic operation of the latches is described in U.S. Pat. 3,799,364. In brief the hydraulic operation of the latches is shown, for example, in FIG. 3, where there are shown on each rail 73 and 74, manifolds 115, there being in the illustration shown one manifold for each racking finger. Each manifold contains suitable valve means and solenoids (not shown) for actuating the valves for each latch on the racking finger served thereby, together with hydraulic lines leading to the latch-actuating mechanism and electrical connections leading to a computer control means, which will be more particularly described hereinafter.

There is also illustrated in FIG. 3 a portion of the upper racker means 51, including a racker arm 118 having a racker head 119 with pipe-guiding means, herein referred to as a latch or claw 121 on the end thereof. Illustrated as being held in the claw 121 is the stand of drill pipe 49. The racker arm 118 is mounted in a carriage 122 (FIG. 1) and has means, as will hereinafter be described, for extending and retracting the arm longitudinally. In addition, the carriage 122 is mounted in a horizontal track means or frame structure 125 extending horizontally along the side of the derrick, and has means, as will also hereinafter be described, under the control of the computer means, for moving the carriage laterally in the track means from side to side of the derrick. Such racker arms and carriage means are actuated by hydraulic motors under control of the electrohydraulic or manually controlled systems hereinafter to be described.

Referring again to FIG. 1, it will be noted that the intermediate racker assembly 52, like the upper assembly 51, comprises a carriage 122 and a frame structure 125 which supports the carriage 122 for movement laterally with respect to the side of the derrick. The general details of the carriage and frame structures are shown in U.S. Pat. No. 3,615,027 to Ham, J. E. In brief, the lifting head 152 of the intermediate carriage 52 may be raised and lowered by the cable 66, which is suitably connected to the lifting head. In one embodiment, as for example that is shown in FIG. 4, the cable 66 is provided with a wire rope socket **66*a* connected through load sensing apparatus 297 to a web 66*c* provided on the lifting head 152. In addition, if desired, a roller 166 may be journaled between ears 167 provided at the upper end of the head support 153, so as to engage the cable when the head 152 is lowered. The lifting head 152** may be constructed similarly to that one shown in U.S. Pat. No. 3,615,027, Ham J. E.

Further shown in FIG. 4, is latch or claw means 185 which is shown in detail in FIG. 5, and which is provided for engaging a drill pipe or drill collar. The claw 185 comprises a lever 186 pivotally connected to the body of the lifting head 152 as by means of a pivot pin 187. The lever 186 includes an actuator arm 189 and a working arm 190, the latter extending generally arcuately in the nature of a claw and having an inner arcuate surface 191 adapted, when the lever arm 190 is in one position, to engage a drill pipe tool joint or a drill collar to apply force thereto tending to urge same into the appropriate throat **180*a* or surface 176*a* of the drill pipe supporting slide 180 and the adapter plate 176, respectively, while being movable to a second position as shown in broken lines in FIG. 5**, at which they are opened for reception of the drill pipe or drill collar.

Actuator means 195 are provided for effecting the movement of the drill pipe supporting slide 180 between the outwardly projecting position and the retracted position, and actuator means 196 are provided for effecting the movement of the hook or claw lever 186 between the full line and broken line positions of FIG. 5. The acutator means 195 and 196 are more particularly described in U.S. Pat. No. 3,615,027.

Figure 8A:
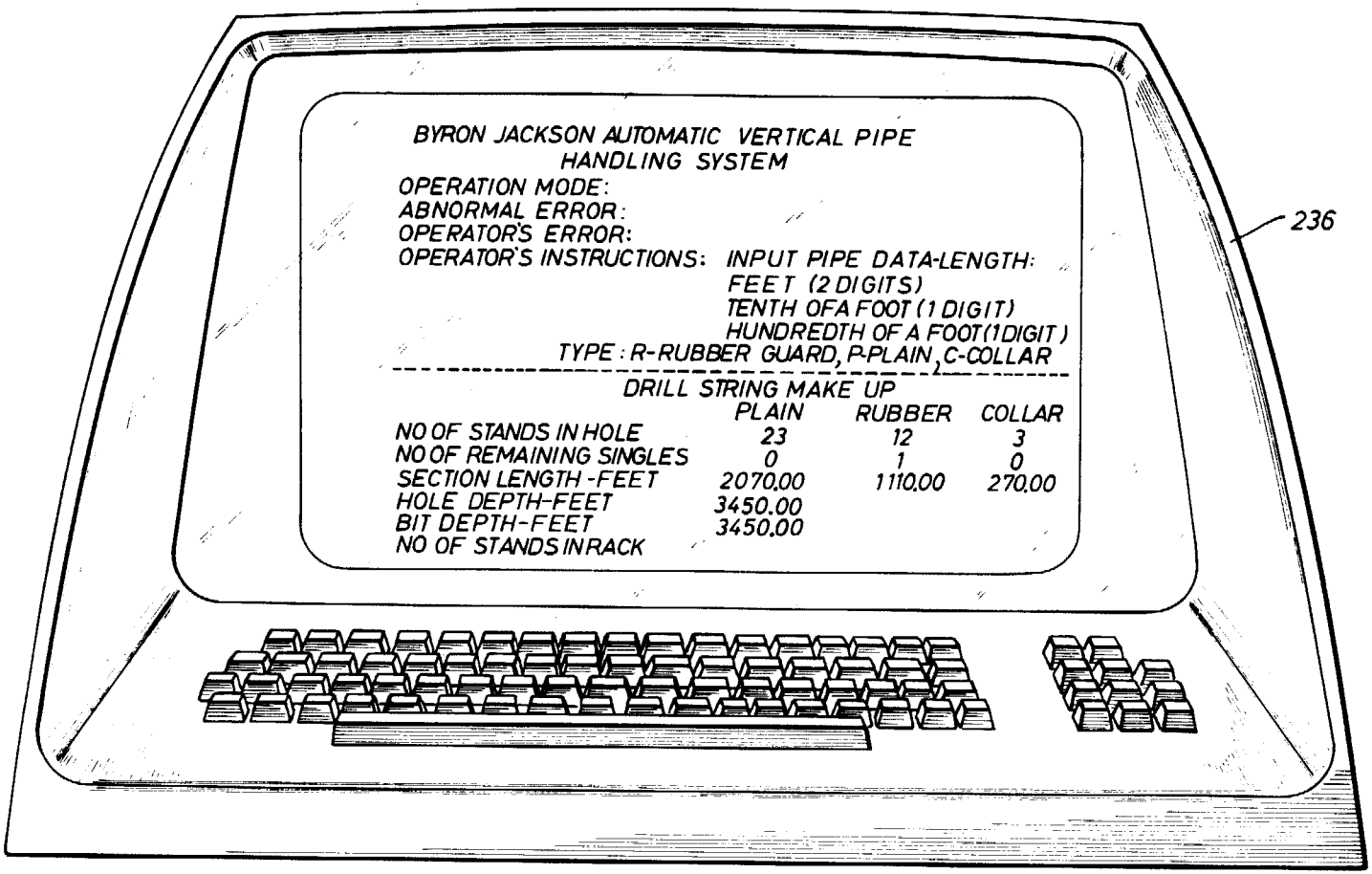
FIG. 8A is a detail view of the cathode ray tube display unit of the computer system.

Control of the respective actuator means 195 and 196 may be effected by a floor man B (FIG. 1) by the operation of a suitable valve control means, or in the automated function described hereinafter, by a computer control means 235 (FIG. 8).

Without requiring further illustration and with reference to FIG. 1, it will be apparent that the upper pipe racker 119 on the racker arm 118 may be likewise constructed, including the provision of the previously described hook or claw 121 thereon, that said claw may be opened or closed to confine an upper portion of stand of drill pipe, such as the stand 49 or FIG. 1, or a stand of drill collars, such as the stand 54 of FIG. 1, against lateral movement relative to the head 119, and the stand may be elevated and lowered relative to the head 119. In addition, while the means 62 of FIG. 1 has been previously described as casing handling apparatus, such means may include another head and claw means adapted to effect sliding engagement with the stand in certain pipe handling operations. In many pipe handling operations only one of the aforementioned pipe racker means 51, 52 and 62, may be required. For example, the pipe racker 52 may be the sole handling apparatus for drill pipe stands 49, with the vertical arm 153 being provided, for example, with one or more claw means 121 for holding the pipe therein.

From the previous description of the mechanical apparatus utilized in the handling of pipe which may be made up into or broken out of a drill string, it will be evident that controlling the pipe handling system automatically would greatly increase the efficiency of the system. Accordingly, there will next be described, the apparatus and controls associated with automatically controlling the hydraulically powered pipe handling system.

PICTORIAL SCHEMATIC OF SYSTEM CONTROLS

Referring to FIG. 8, there is shown a diagram of the input and output signal information which may be directed to and from central controller 235. Controller 235 may be a general purpose digital computer, such as the PDP-8/E manufactured by Digital Equipment Corporation of Maynard, Massachusetts. As shown in FIG. 8, there are two input/output console devices which provide information to an operator as to the status of the operation of controller 235, and which may be utilized to provide updating information to controller 235. CRT 236, which may be a cathode ray tube display and keyboard unit such as Model No. VT05-A-AA, manufactured by Digital Equipment Company, is further shown in FIG. 8 (a) with a typical message to the operator displayed. The information shown illustrates the makeup of the drill string as complied from input information, which will be further described hereinafter. CRT 236 displays information respecting the amount of pipe in the hole, hole depth, bit depth and other information as may be required by the operator. The remaining input/output console device is the driller's control panel 237 which permits an operator to input certain limited amounts of information to controller 235 through positional switches on the base on the control panel 237. FIG. 8 (b) shows a typical layout of driller's control panel 237 whereby auto/manual switch 238 is utilized to control the automatic or manual functioning of the drill pipe handling system. There are also provided additional controls, such as a restart switch 239, which restarts the program sequenced after an interruption for equipment malfunction or for interrogation of the operator to insure the proper steps requiring manual actuation of a control have been accomplished, and indicator lamps provide an indication of the operating status of the automatic system. Other manual switches on the control panel permit the stopping of the automatic pipe handling sequence. An interruption may occur as an intentional pause at certain points in the racking sequence included in the program logic or by actuation of the stop switch. An interruption may also occur automatically responsive to the program logic in the event a malfunction should occur. Appropriate indicator lamp signals may be energized to indicate the interruption sequence. A programmed pause may also occur in the event a handling sequence occurs and for the operator to respond following a programmed pause and interruption for a possible drill string change.

Referring to FIG. 8, controller 235 in response to a programmed sequence of instructions (a computer program), generates control signals which include X-Y axis selector 241, claw control 242, lifting head control 243, and finger latch selector and control 244.

Positional information is provided to the upper and intermediate racker servo systems through lines 245 and 246. In order to ascertain the precise location of the lifting head associated with the intermediate racker, positional information is supplied to controller 235 through line 247 from a lifting head position transducer (not shown).

There are certain feedback signals furnished for the automatic operation of the vertical pipe handling system, which feedback signals are input to controller 235 by way of input line 248 (which may be a multiplicity of individual lines). The function of the various feedback devices will be more particularly explained hereinafter; however, included are the racker in motion sensor 251, excess racker position error sensor 252, claw open/close sensor 253, lifting head unloaded/loaded sensor 254, finger latch operated sensor 255, block retracted sensor 256, elevator closed and locked sensor 257 and hydraulic filter alarm sensor 258.

The particular electrical and hydraulic controls will be hereinafter explained, but the general function of each of the above-listed controls is as follows:

1. X-Y axis selector 241 function to select the proper axis of the respective carriage and racker assemblies, according to the particular direction of movement desired. The carriage and racker assemblies are designed to move only along one axis at any one time, and further to accept no movement command while in motion along the non-selected axis.

2. Claw control 242 functions to open and close claw 121 (FIG. 3) of upper racker assembly 51, and similarly the claw of the intermediate and lower racker assemblies, if present in the particular embodiment.

Figure 14:
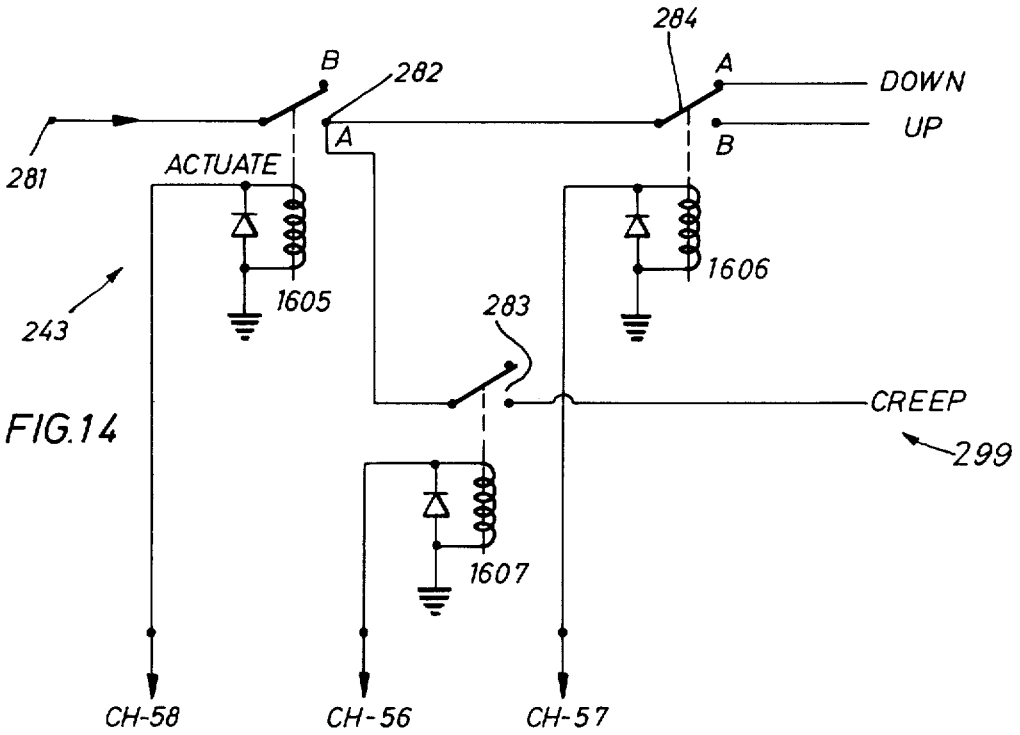
FIG. 14 is an electrical schematic of a portion of the controls associated with the lifting head.

3. Lift head control 243 controls the vertical movement of the lifting head 152 associated with the intermediate racker assembly 52 (FIG. 1). Lift head 152, as will be recalled from the foregoing details of the mechanical apparatus, lifts pipe stand 49 from drill string 26 for movement to racker board 55 adjacent the side of derrick 22. Similarly lift head control 243 (FIG. 14) lowers lift head 152 and therefore drill pipe stand 49 onto drill string 26 for connection therewith.

4. Finger latch selector and control 244 interfaces with racker board 55 (FIG. 3) and directs a particular finger 97 (or several fingers) to open or close, dependent upon the sequence of pipe handling currently operative.

5. Positional information may be generated by controller 235, and through appropriate interface devices, to the upper, intermediate and lower racker servo systems, the combination depending upon the particular embodiment. The positional information directs the particular racker assembly to the desired location, being dependent upon whether the pipe handling system is removing or replacing dull pipe from or into the drill string.

6. The lifting head, as previously mentioned, is used to raise or lower the pipe stand 49 into or out of engagement with the drill string 26 at the well centerline and to raise or lower the pipe stand at the set back 56 (FIG. 1) adjacent the side of derrick 22. The lifting head is arranged for two speed operation in which a creep speed is used for the final increment of vertical movement in picking up or setting down the stand.

At various points in the following description, there will be references to terminals by the designation CH-XX. This indicates an input or output channel of the Universal Digital Controller (UDC-8). The UDC-8 serves as the interface between the electrical circuitry of the various operating systems and the digital computer. All such input channels are not specifically referred to, although it is understood that each signal to or from the controller must be first applied through interface device.

FEEDBACK SENSOR SYSTEM

Referring again to FIG. 8, controller 235 is provided with certain input and feedback signals from the various components of the operating system, so as to insure proper operation of the mechanical apparatus prior to issuing a command for a further step in the automated sequence.

Racker in motion sensor 251 is a velocity sensing apparatus that measures voltages induced by movement of the carriage or arm of the racker assembly in order to ascertain that neither the arm nor the carriage are moving prior to controller 235 proceeding to the next step in the automated sequence.

Figure 11:
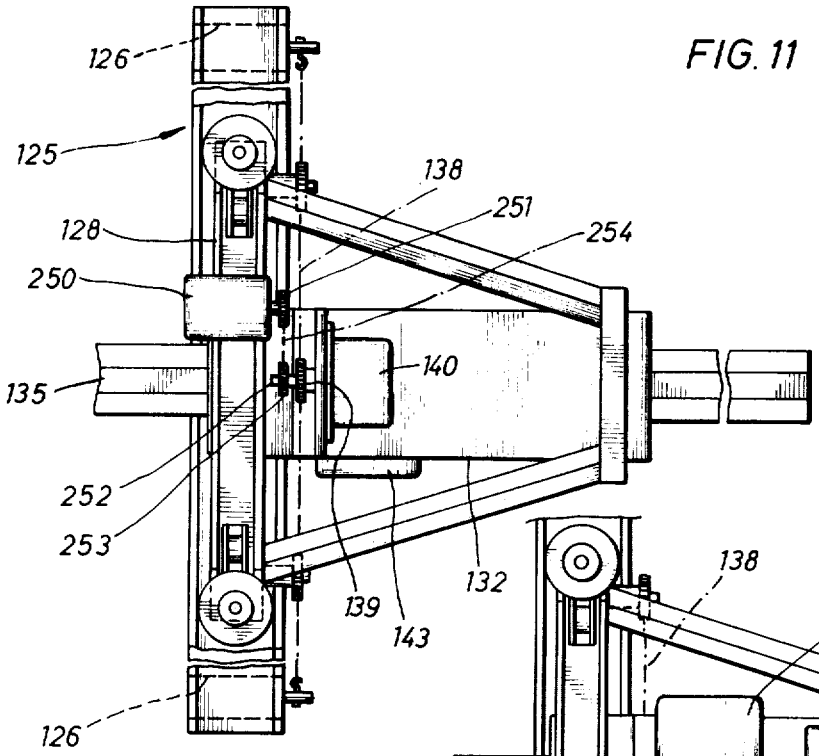
FIG. 11 is a bottom view of the racker assembly of FIG. 11A, showing the tranducer associated with determining the position of the racker assembly.
Figure 11B:
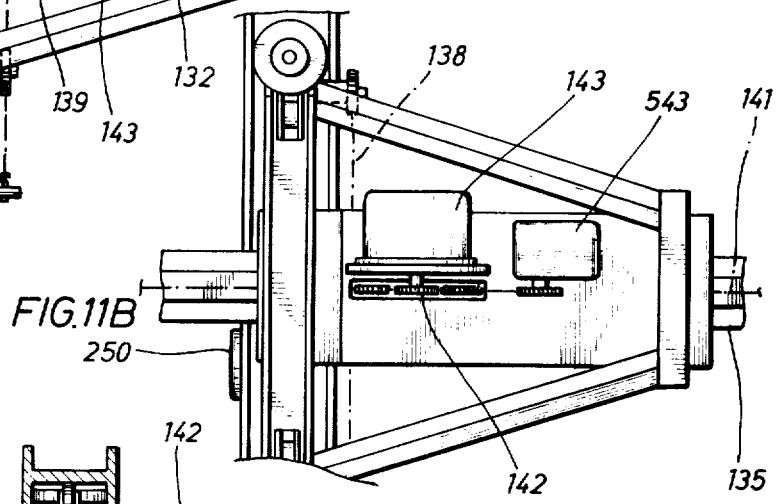
FIG. 11B is a top view of the racker assembly shown in FIG. 11A.

The motion of the arm and carriage assembly is sensed directly from the movement of the hydraulic motor powering the respective moving parts. Referring to FIG. 11, the means for effecting lateral movement of the carriage 122 within the frame 125 is shown. Such means comprises a drive chain 138 extending across the frame 125 and connected at its ends to the frame side members 126, the chain engaging a drive sprocket 139 adapted to be driven by a reversible motor 140, the motor being suitably mounted on the guide 132. Means are also provided for sensing the position and velocity, if any, of the carriage 122, and illustratively, such means comprises a transmitter assembly 250. Transmitter assembly 150 is suitably mounted on carriage support member 128, with its sprocket 251 being in parallel alignment to the shaft 252 of hydraulic motor 140. There is further mounted on shaft 252 of motor 540 a sprocket 253, which is joined with sprocket 251 of transmitter assembly 250 by drive chain 254.

Figure 12A:
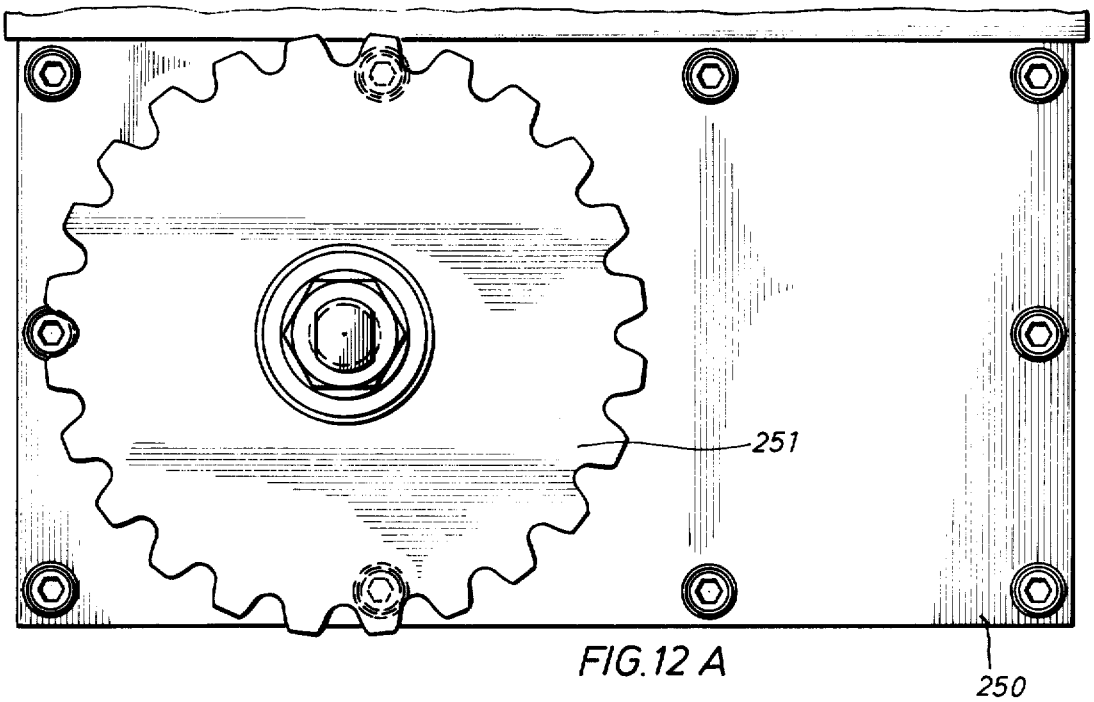
FIG. 12A is a top view of the transducer assembly of FIG. 12.
Figure 12:
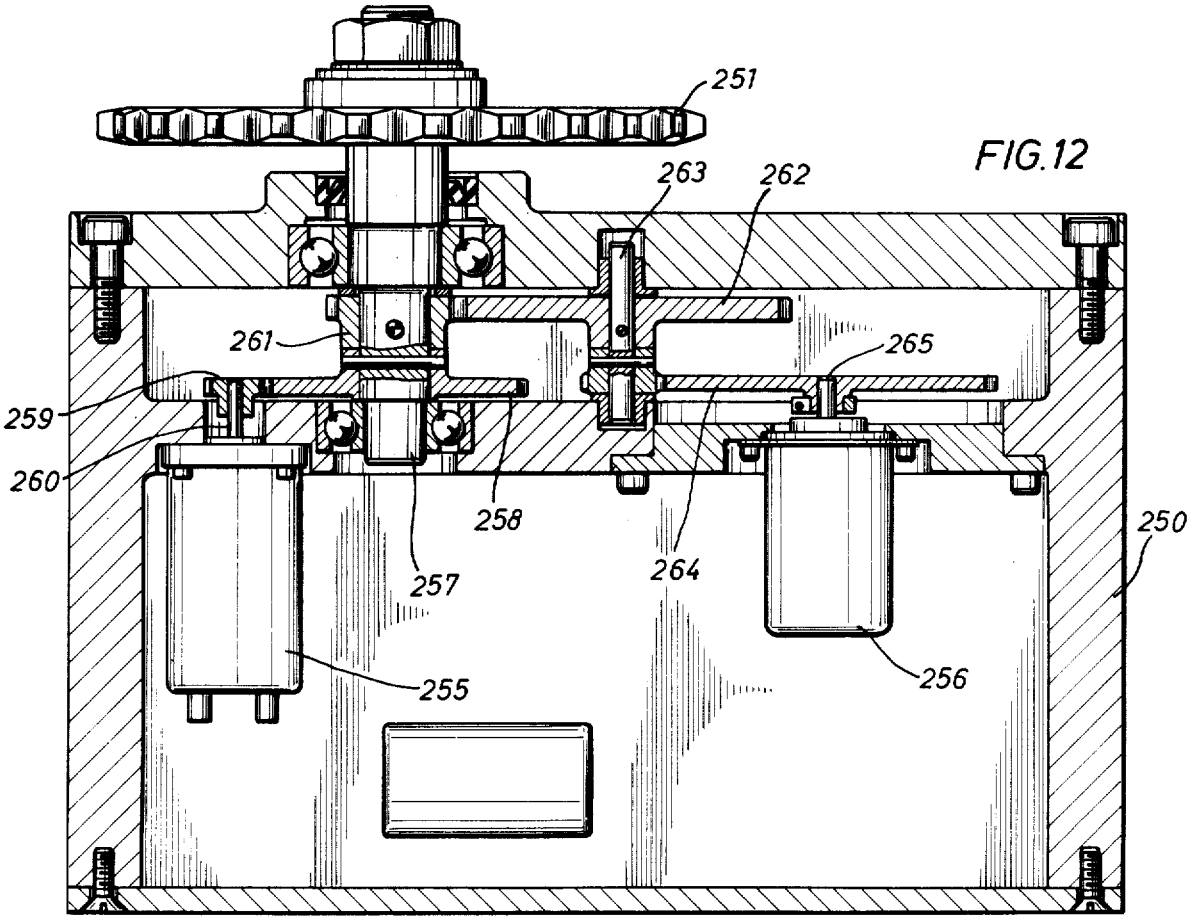
FIG. 12 is a sectional view of a typical transducer assembly.

Referring to FIG. 12, transmitter assembly 250 is shown in detail. Sprocket 251 being driven by chain 254 (FIG. 11) through appropriate gearing, turns transmitter tachometer generator 255 and transmitter synchro 256. Shaft 257 is turned by sprocket 251 which the turns gear 258 which engages gear 259, gear 259 being rigidly attached to shaft 260 of tachometer generator 255. Further, gear 261 engages gear 262, which in turn, being mounted on shaft 263, engages gear 264, and causes rotation of shaft 265 of sychro transmitter 256. Tachometer generator 255 which may be one such as that manufactured by Servo-Tek, part no. SB74OB-1, produces a voltage signal indicative of movement of carriage 122. Transmitter synchro 256 is utilized to determine positional information, that is, the location of carraige 122 within the frame 125. Transmitter synchro 256 may be one such as part no. 7R910-1A as manufactured by Kearfott, a division of the Singer Corporation.

Figure 11A:
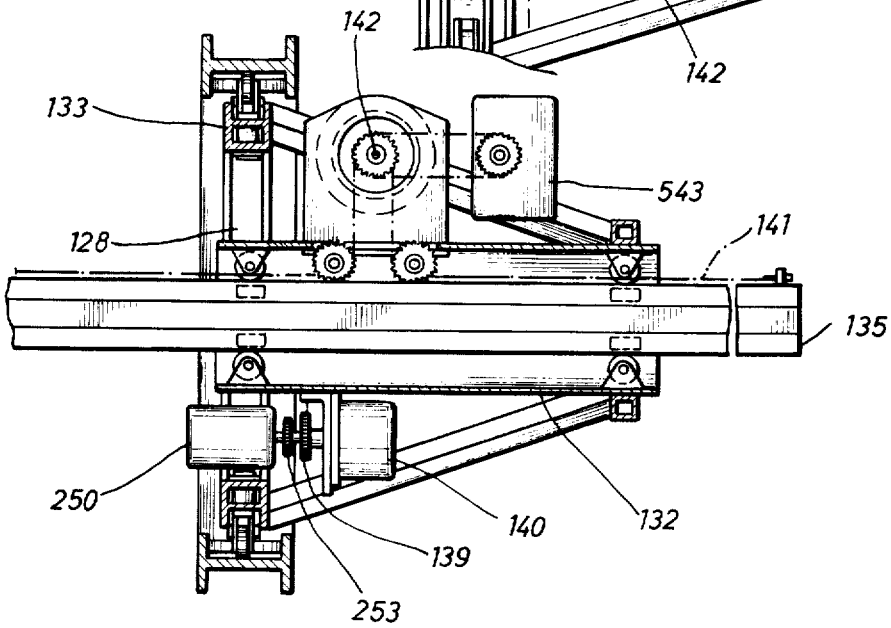
FIG. 11A is a side view of the racker assembly.

Means are also provided for effecting longitudinal movement of the arm 135, and, illustratively, such means comprises a chain 141 (FIG. 11*a*) extending longitudinally above the arm and attached at its opposite ends to the arm. A sprocket 142 driven by a reversible motor 143 acts to move the chain 141 and thus the arm longitudinally on the guide 132. In a manner requiring no further illustration, it will be understood that both of the chain drive motors 140 and 143 may be conventional rotary hydraulic motors adapted to be operated in reverse directions in response to controller 235 in the automated mode of operation or control means under control of the floor man B at the console on the floor of derrick 22. It will be further understood that transmitter assembly 543, being suitably mounted to carriage frame 133, similarly determines the position and relative movement of carriage arm 135.

It will be understood that the positional information required from the intermediate and lower racker arm and carriage systems, in those embodiments employing same, may be obtained in a similar manner.

Referring to FIG. 4, there is shown the lifting head 152 which engages pipe stand 49 for lifting said pipe stand from a position adjacent the drill string 26 (FIG. 1) and lowering pipe stand 49 onto setback 56 adjacent the side of derrick 22.

Figure 13:
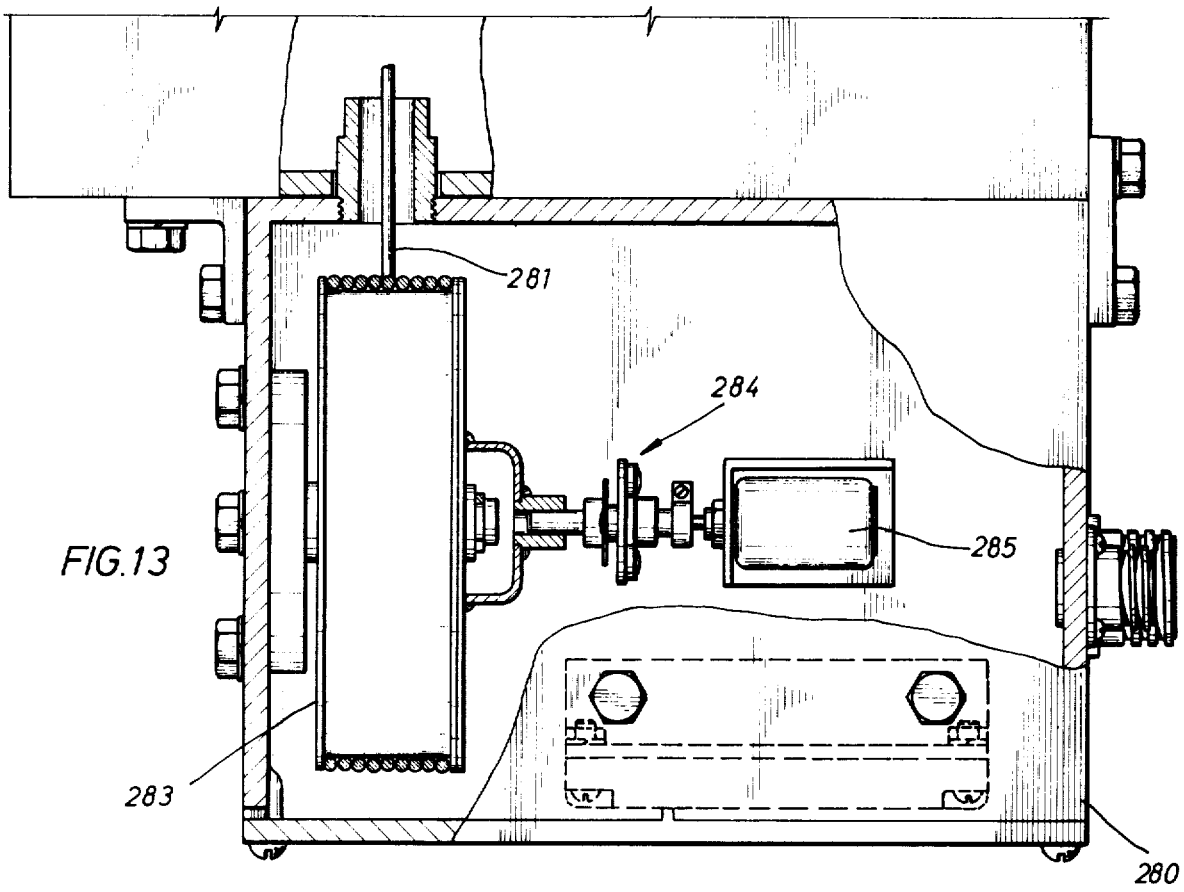
FIG. 13 is a partial cutaway view of the transducer associated with the lifting head.

Further referring to FIG. 13, there is shown position transducer assembly 280 for determining the vertical position of lifting head 152 (FIG. 1). In operation, position transducer assembly 280 contains a suitable cable 281 which is affixed to lifting head 152 at connector 282 (FIG. 4). Cable 281 is then wound around reel 283 which permits the extension and retraction of cable 281 from reel 283 as lifting head 152 moves in the vertical direction. Reel 283 is a spring powered reel, and may be one such as that manufactured by Ametek/Hunter, part no. ML-2800. Through suitable couplng 284 the shaft of potentiometer 285 turns in slave relation to reel 283. Potentiometer 285 may be one such as that manufactured by Amphenol, part no. 2101B. By sensing the voltage of the wiper arm of potentiometer 285, the position of lifting head 152 relative to head support 153 may be determined.

Figure 10A:
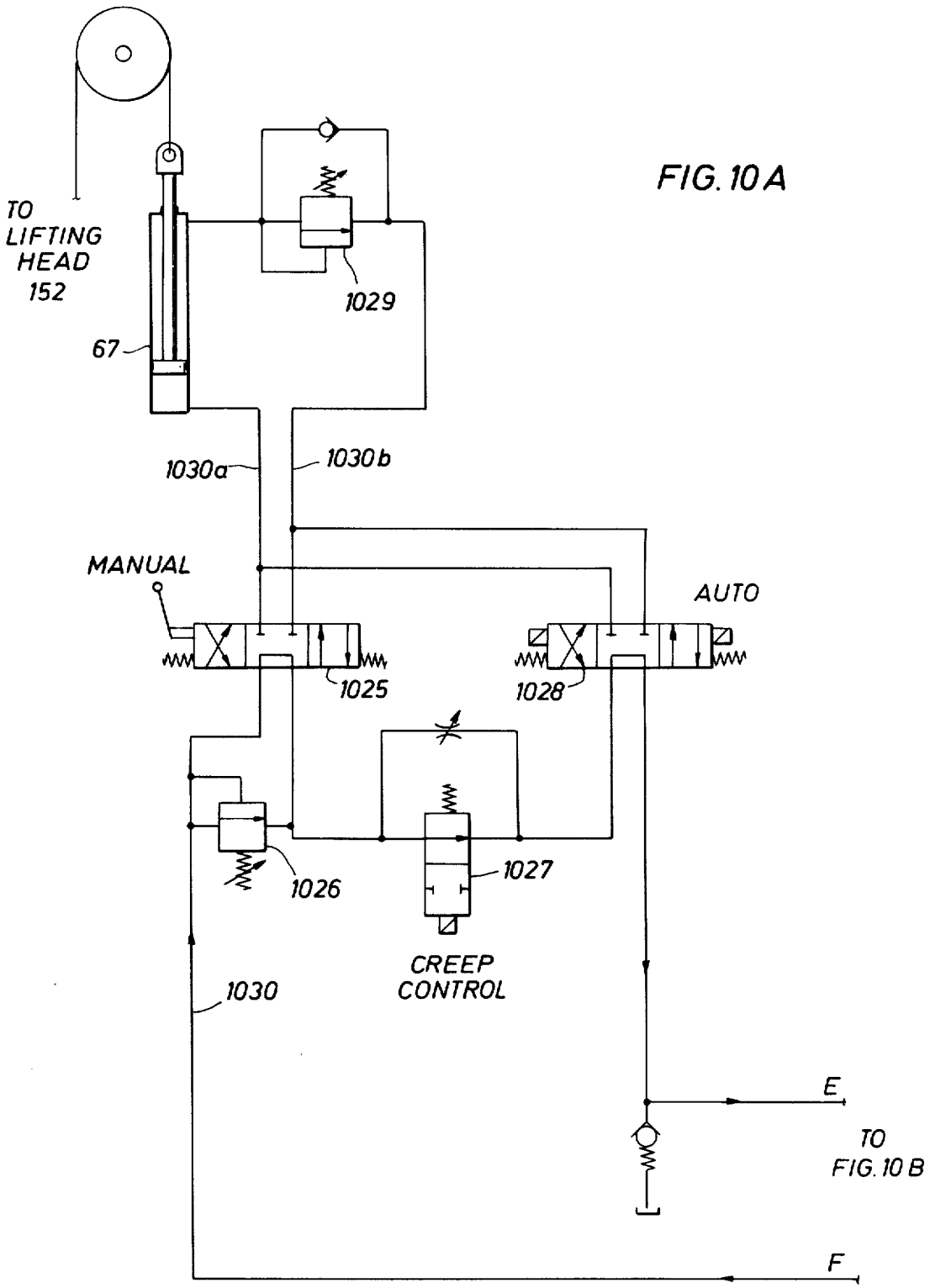
FIGS. 10A, 10B and 10C are schematic views of the hydraulic piping associated with the racker control mechanisms and stand lift.

Referring to FIG. 10A, it will be seen that there is associated with lift head 152 a creep control 299. Creep control 299 which may be an orificed hydraulic valve, is electrically controlled by suitable electric circuitry, such as that shown in FIG. 14. At terminal 281 there is a supply voltage impressed which enables the lifting head controls to function in response to signals from controller 235. In order to enable the circuitry of FIG. 14, a signal from controller 235 is applied to CH 58 which energizes coil 1605 thereby closing switch 282, and, if no further signal is applied, the lift head will proceed in a downward direction. A further signal from controller 235 at CH 56 causes coil 1607 to energize, thereby closing switch 283 and reducing the velocity of the vertical movement of lift head 152 to its lower or creep velocity. In similar fashion, a signal from controller 235 to terminal CH 57 energizes coil 1606, closing switch 284, thereby reversing the movement of the lifting head to its upward direction.

Again referring to FIG. 8, the various input signals are received by controller 235 through line 248, which may be a multiplicity of lines tied into the interface device between the feedback sensors and controller 235. The interface device may be one such as the Universal Digital Controller, Model No. UDC-8, as manufactured by Digital Equipment Corporation.

As partially shown in FIG. 8, the input-output apparatus associated with the controller 235 includes the interface device, the UDC-8, driller's control panel 237, CRT 236, and an analog-to-digital converter, which may be one such as that manufactured by Digital Equipment Corp. and designated Model No. AD01A. As partially shown in FIG. 8, the input-output apparatus associated with the controller 235 includes the interface device, the UDC-8, driller's control panel 237, CRT 236, an analog-to-digital/digital to analog converter such as the model AD01A (manufactured by Digital Equipment Corp. of Maynard, Massachusetts) a high speed paper tape reader and punch such as the model PC8-EA (also manufactured by Digital Equipment Corp.), and a mass storage memory device such as the model TC08-TU56 DEC tape (also manufactured by Digital Equipment Corp.) or a DF32D DEC disc unit (also manufactured by Digital Equipment Corp). These devices may be referred to collectively as input-output means and are utilized in the monitoring of the various feedback sensors and controller 235, and controlling and loading program input and output to controller 235.

Of course, the CRT 236 may be a "Teletype" type device which is commonly used as an input-output device in place of CRT 236.

The excess position error sensor 603 (FIG. 9) compares the position error signal existing on line 637, as discussed hereinbelow in the section hereof entitled Racker Servo Systems, with a preselected level. In the event of the actual position of an arm or carriage assembly differing from the predetermined position by a selectable amount deemed excessive, the pipe racking sequence is halted and the system returned to its manual mode. This transfer occurs when the electrical input signals to the various servomechanisms are interrupted, thereby causing the servomechanisms to fail to the manual mode. This feature is incorporated to prevent the automated pipe handling system from accepting a spurious or other incorrect signal and causing damage to the equipment or danger to personnel directing the operation of the equipment.

Claw open and close sensor 253 may be implemented by using two limit-switch actuators, for example, such as Model No. AO-1 manufactured by Parker-Hannifin of Des Plaines, Ill. The switches may be mounted at a location on the claw actuating cylinders, determined by the particular switch chosen, and generally sense three positions of the actuating rod, 201, (FIG. 5) that is, (1) piston rod fully retracted, (2) in motion, and (3) fully extended.

Figure 15:
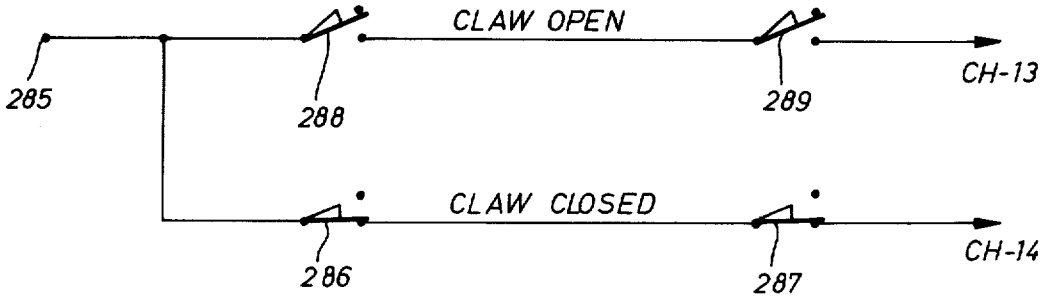
FIG. 15 is an electrical schematic of the feedback circuit associated with the claws of the racker and lifting head.

Referring to FIG. 15, typical electrical circuitry is shown which may generate the feedback signal to controller 235 from one or more claws associated with the racker arms. In the particular schematic shown, there is provision for two sets of sensors, one set on each of the upper and intermediate racker arms. At terminal 285, there is a voltage applied which, with switches 286 and 287 in the positions indicated in FIG. 15, will provide a signal to controller 235 through the UDC-8 interface at CH-14 indicating the two claws are closed. This feedback signal is desirable in order to assure closure of the claws prior to moving the racker arms or carriage assemblies while a pipe stand 49 is engaged by the respective claws. Similarly, actuation of hydraulic cylinder 196 (FIG. 4) to its piston-fully-extended position actuates switches 288 and 289 to their closed position, and opens switches 286 and 287, thereby providing a voltage signal at terminal CH-13, providing to controller 235 a claws open signal.

Figure 2:
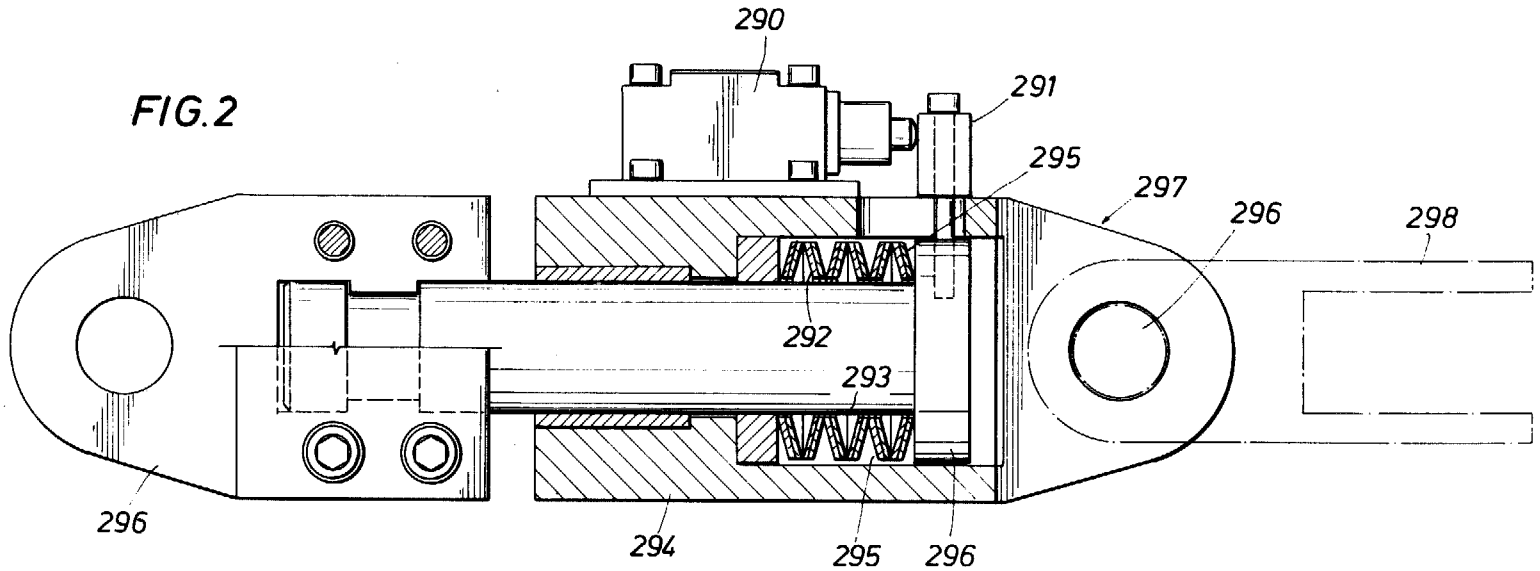
FIG. 2 is a partial schematic of the lifting head load sensor.

There is provided a sensor associated with lift head 152 for determining whether lift head 152 is supporting the weight of a pipe stand 49. Referring to FIG. 2, a clevis coupler 298 is attached to web 66c (FIG. 4) of lift head 152. Attached to the clevis 298 through pin 296 is the lifting head load sensing apparatus indicated generally at 297. Load sensing apparatus 297 is connected to wire rope 66 (FIG. 4) through the members 294 and 296. Members 294 and 296 are suitable arranged such that there can be relative motion between the two when there is a load placed on lifting head 152. This relative motion occurs at interface 293 which, in part, defines the inner surface of a chamber 295. Located within chamber 295 is a suitable movement restricting means, which may comprise Bellville washers 292, to inhibit the movement of member 294 with respect to member 296. Upon lifting head 152 being loaded with a weight, such as when lifting drill pipe stand 49, member 294 is pulled away from member 296, thereby causing pin 291 to actuate limit switch 290. Of course, limit switch 290 is affixed to member 294 and pin 291 is affixed to member 296 such that motion between the respective members 294 and 296 translates into motion between pin 291 and limit switch 290 for providing a feedback signal to controller 235 indicating there to be a loading on lifting head 152. Limit switch 290 may be one such as Model No. 2LS-1, manufactured by Honeywell Corporation.

Figure 16:
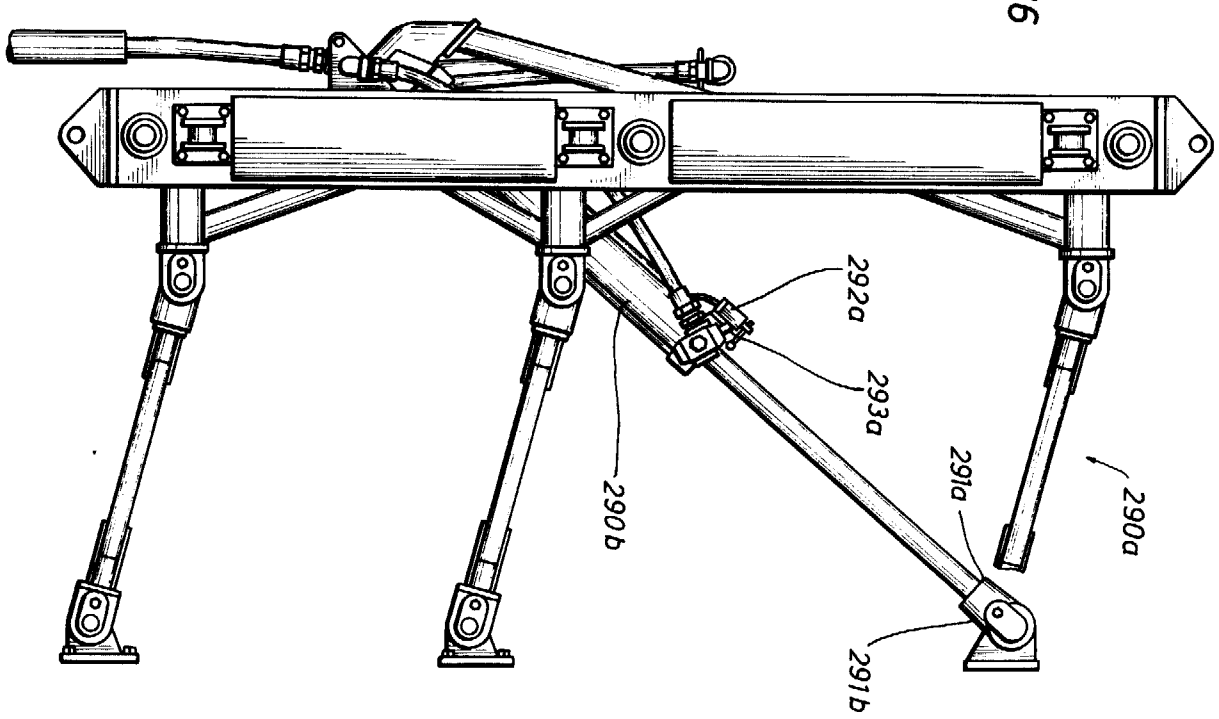
FIG. 16 is a side view of the block retractor assembly.

In order to provide a signal to controller 235 that the traveling block 35 (FIG. 1) is retracted from the well center line, there is provided on retraction linkage illustrated generally at 290a (FIG. 16) a limit switch for sensing the retraction of the traveling block 35. Referring to FIG. 16, the block retracting linkage is shown in further detail. Linkage 290a comprises a hydraulic cylinder 290b which extends and retracts member 291b. Limit switch 208 may be one such as Model No. 802 T-A manufactured by Allen-Bradley Company, being a two-position switch, spring-loaded to the off position, and sensing retraction of hydraulic cylinder 290b engages the lever arm 293a of switch 292a. A signal is then generated to controller 235 indicating full retraction of the traveling block 35 (FIG. 1) from the well center line. It is desirable that an accurate determination of the position of block 35 be made in order that hook structure 38, link 42 and elevator 44 not interfere with the movement of pipe stand 49 as it is transferred from pipe rack to well centerline or vice versa. In the event that switch 292a does not actuate, the automatic pipe handling sequence is halted and an appropriate error message is displayed on the CRT console.

Referring again to FIG. 1, elevator 44 has means for closing and locking a collar about pipe stand 49 prior to lifting or lowering the drill string. In order to provide positive feedback to controller 235 that elevator 44 is closed, latched and locked, there is provided means for sensing the closure of an elevator latch lock and generating a signal to controller 235 confirming such closure.

Figure 17A:
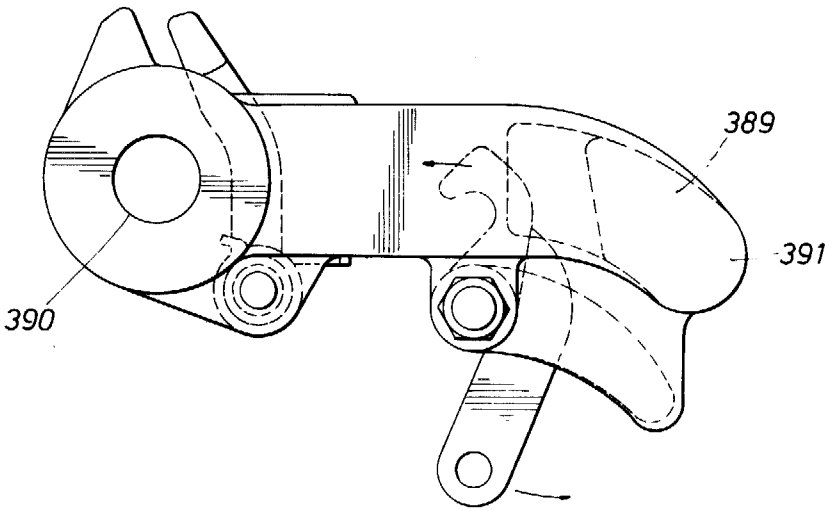
FIG. 17A is a top view of the elevator latch mechanism.
Figure 17B:
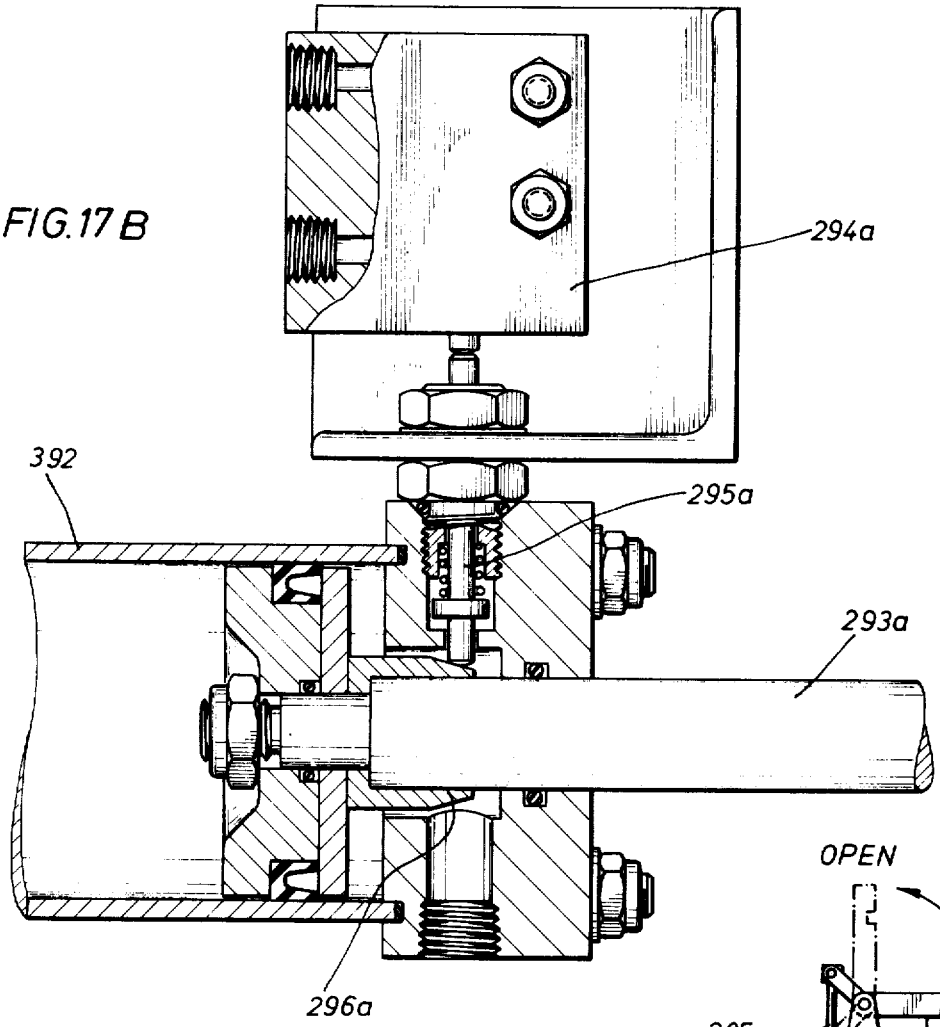
FIG. 17B is a detail view of the pneumatic actuating apparatus associated with the elevator latch mechanism.
Figure 17:
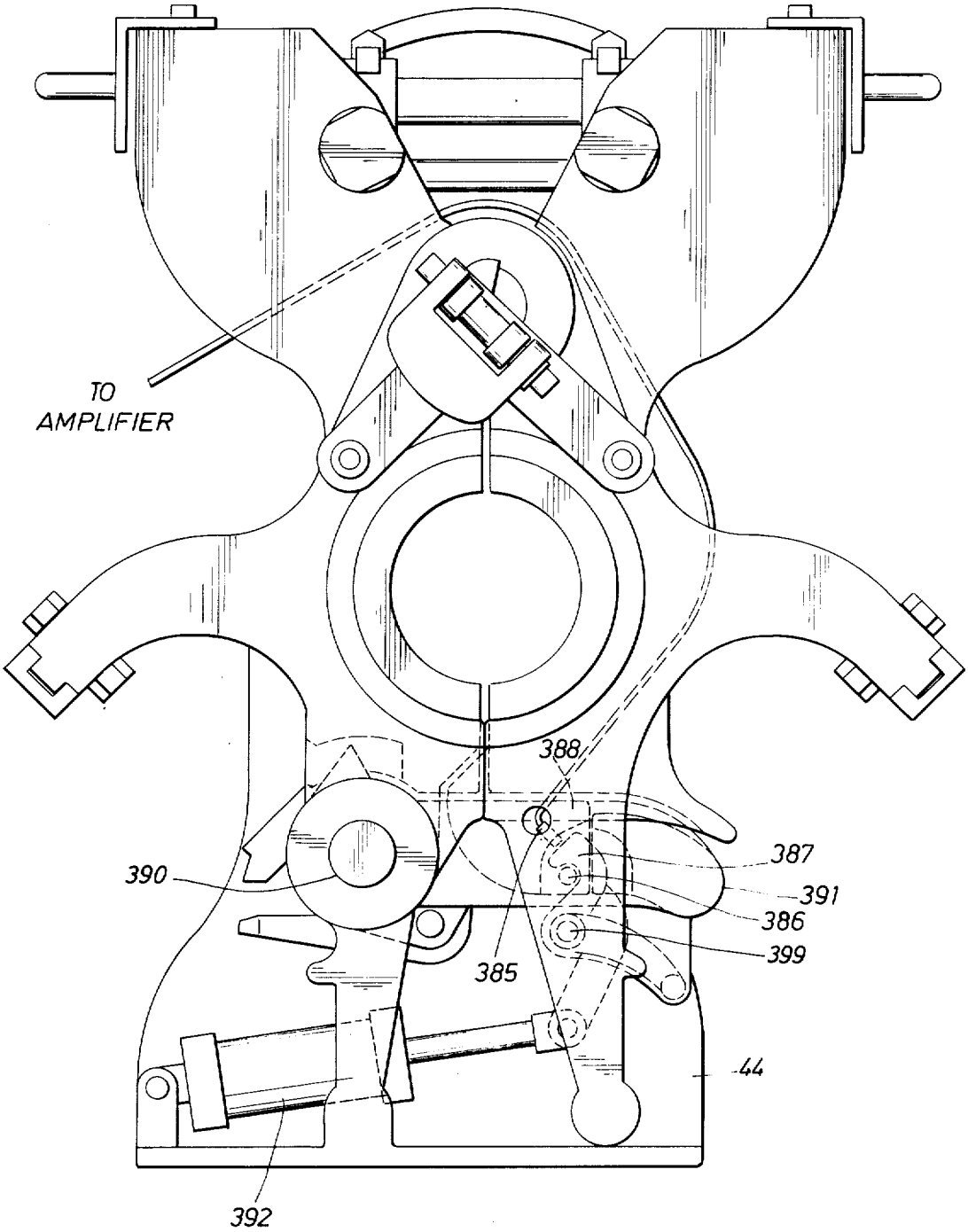
FIG. 17 is a top view of the elevator and elevator feedback sensor.

Referring to FIG. 17, there is illustrated a portion of the frame assembly of elevator 44. There is provided means associated with elevator 44 for latching and locking the elevator to prevent the elevator from inadvertently opening while supporting the weight of a pipe stand. Latch assembly 391, being separately shown in FIG. 17A rotates about latch pin 390 as elevator 44 closes so as to prevent inadvertent opening of the elevator. On the opposite face of latch assembly 391 from that shown in FIGs. 17 and 17A is a raised shoulder 389 which engages a mating raised shoulder 388 associated with the opposite side of elevator 44. After latch lock 387 is moved to its closed position about door lug pin 386, latch assembly 391 is prevented from moving, thereby preventing the elevator 44 from opening. A further safety measure is provided through latch lock 387 which closes about door lug pin 386 as the elevator closes, being driven to its closed position by a spring about pin 399. After latch lock 387 is moved to its closed position about door lug pin 386, latch assembly 391 is prevented from moving, thereby preventing the elevator 44 from opening. In order to open elevator 44 when it is desired to release the elevator from a pipe stand, there is provided pneumatic cylinder 392 which through intermediate linkages causes latch lock 387 to rotate in a clockwise direction as viewed in FIG. 17, thereby releasing the positive lock from latch assembly 391. In order to sense positive closure of the elevator and correct functioning of the latch assembly, there is provided a metal sensing proximity switch 385 which, with latch lock 387 in its locked position generates a feedback signal to controller 235 insuring the proper functioning of the elevator closing and locking mechanisms. Proximity switch 385 may be one such as that manufactured by R. B. Denison, Inc, and designated Model No. NJ 1.5-6.5-N.

Referring to FIG. 17B the actuating cylinder 392 is illustrated in an alternative embodiment which may be utilized to sense proper closure and locking of the elevator latch and latch lock assembly. The cylinder rod 293*a* of actuating cylinder 392 moves in or out (as shown) according to the desired position of elevator 44. Switch 294*a*, being mounted on the body of cylinder 392 has an extended shaft 295*a* which contacts cylinder rod 293*a* or collar 296 or actuating cylinder 392. In the position shown, the shaft 295*a* is urged toward the actuated position within air limit valve 294*a* by collar 296*a* thereby providing a positive indication of the positions of cylinder rod 293*a* and thus proper closure and locking of elevator 44. Air limit valve 294*a* may be a cam valve limit switch, such as Model No. CV-18, as manufactured by Snyder Machine Company of Hawthorne, California.

RACKER SERVO SYSTEMS

Figure 9:
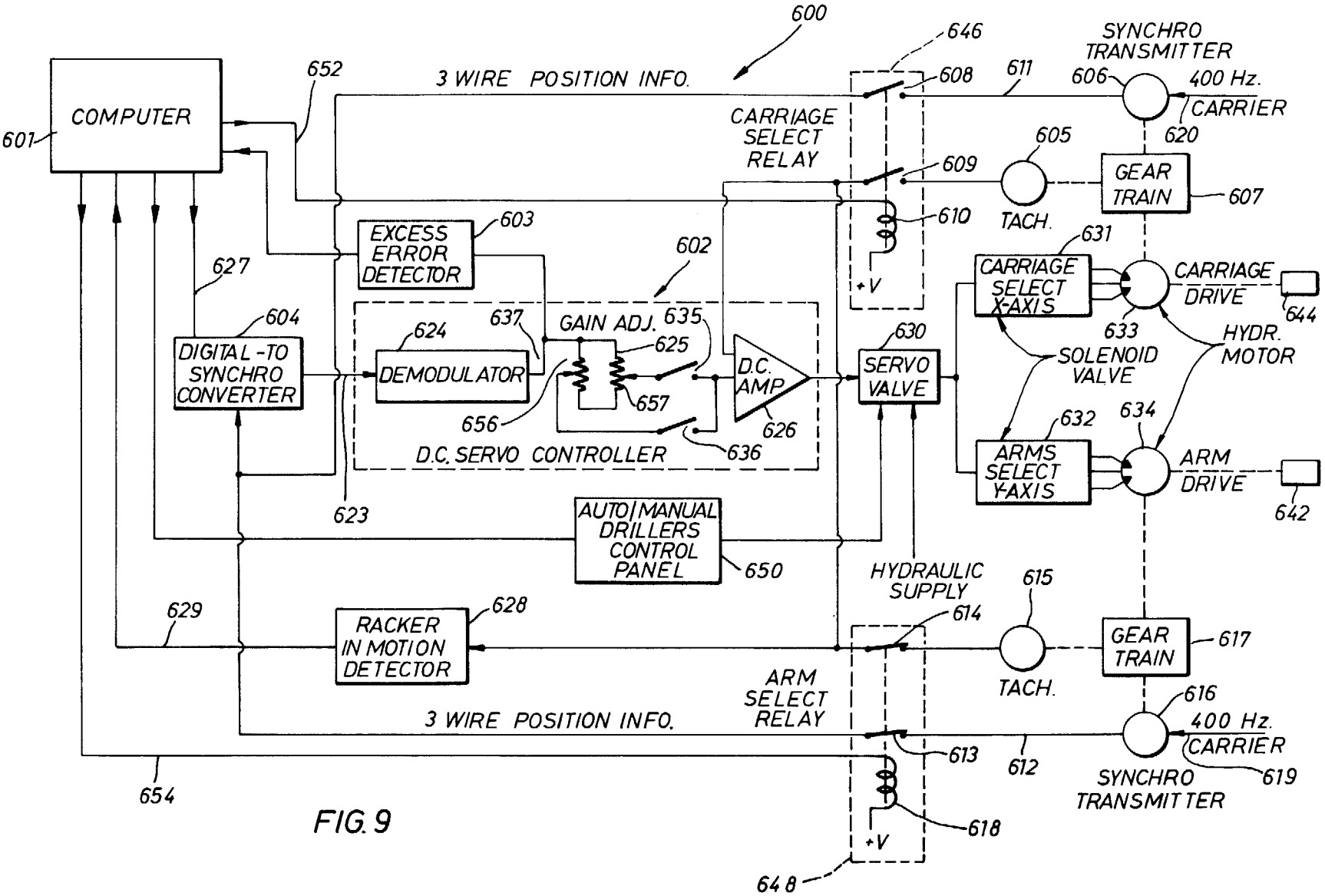
FIG. 9 is a schematic of the electrical controls associated with a racker servo system.

Referring to FIG. 9, there is illustrated upper racker servo system 600 which controls movement of the upper racker assembly 51. Upper racker servo system 600 responds to control commands of controller 235 to produce controlled movement of carriage drive 644 and arm drive 642. The servo system provides movement along two paths, which may be referred to as the X axis and the Y axis. Carriage drive 644 produces lateral movement or movement along the X axis which is along a path parallel to the side of the derrick structure, and arm drive 642 provides extensible movement of the racker arm, along the Y axis, which is to and from the well center line. Driller's control panel 650 allows for either the manual or automated mode of operation of the servo system to be selected.

The upper racker servo system 600 includes carriage and arm drive feedback sensor loops. The carriage drive feedback sensor loop is comprised of gear train 607, tachometer 605, synchro transmitter 606, and carriage select relay 646. Arm drive feedback sensor loop, comprises gear train 617 tachometer 615, synchro transmitter 616, and arm drive select relay 648. Additionally the racker servo system 600 includes digital-to-synchro converter 604; DC servo controller 602; servo valve 630; and solenoid valves 631 and 632.

With the selector switch 238 (FIG. 8B) of driller's control panel 650 in the auto mode, movement of the racker assembly is directed by controller 235. Movement of the carriage and the arm is discreet, that is, only along one axis at any one time. In initiating the automated sequence for moving the arm through arm drive 642, controller 235 directs a signal to arm select relay 648, whereby coil 618 is energized, resulting in the closure of relay contacts 613 and 614. The signal either to coil 610 or to coil 618 being generated by controller 235 may be the output from an open collector driver circuit such as the BM 684 contact output module made by Digital Equipment Corporation. The circuit will be located within controller 235 and this is one part of the previously mentioned UDC-8 interface device.

Feedback information concerning the movement of arm drive 642 is available from tachometer 615 and synchro transmitter 616, with the tachometer sensing velocity and the synchro, by a three wire sensor, determining positional location of the arm with respect to well center line. Both tachometer 615 and synchro transmitter 616 are coupled to arm drive 642 through gear train 617. Gear train 617 may be an arrangement of spur gears positioned on the motor shaft, tach shaft and the synchro transmitter shaft. Interconnection of the various spur gears may be accomplished by the use of idler gears to transfer motion and set gear ratios. The gear train may alternately also include a sprocket and chain mechanism for coupling the motor shaft to the idler gears. Tachometer 615, in response to the rotation of its shaft, produces an electrical DC voltage output with ripple. As the speed of hydraulic motor 634 changes, the angular velocity of the shaft of tachometer 615 will change accordingly, effecting a change in voltage level of the DC output signal. Tachometer 615 supplies its output to racker motion detector 628. Racker motion detector 628 monitors the velocity of movement of arm drive 642 and supplies that information to controller 235 via racker in motion detector line 629. Racker in motion detector 628 conditions the DC output signal of tachometer 615 to remove the ripple from the signal leaving a pure DC level. The value of the DC level is then checked to ascertain when the level is below a preselected value. Upon detecting the desired condition, a signal is generated to controller 235 indicating a cessation of movement. Synchro transmitter 616 is supplied position information from arm drive 642. Synchro transmitter output 612 is a suppressed carrier electrical signal supplied on three leads which provide various voltage levels defining amount of movement of arm drive 642 and therefore the position of the racker arm. A 400 hertz carrier excitation voltage is supplied to synchro transmitter 616. As hydraulic motor 634 moves arm drive 642, movement of the rotor of synchro transmitter 616 occurs. As the rotor turns, voltages are applied to the three leads. The voltage defines angular position of the rotor, and because of the gear coupling to arm drive 642, the position of arm drive 642 is also defined. The position feedback information provided by synchro transmitter 616 is supplied to digital-to-synchro (D-S) converter 604 through arm select relay contact 613. The velocity and position information pertaining to carriage drive 644 is made available in a similar fashion.

In completing the feedback loop, digital-to-synchro converter 604 receives three wire position information from synchro 616 and digital command orders from controller 235 via output line 627. Digital-to-synchro converter 604 combines the position information with the digital command word and produces an analog signal output through D-S converter line 623. This analog signal is known in the art as a suppressed carrier signal. The amplitude of the analog signal defines the magnitude of the position error of the selected drive mechanism. The phase of the analog signal defines the direction of sense of the error. D-S converters are well known in the art of control systems. For example, D-S converter 604 could be one such as that made by Vernitron, Model No. VDCT-401SB. The signal from D-S converter 604 in introduced to DC servo controller 602 through line 623. Specifically, the signal from digital-to-synchro converter 604 is applied to phase sensitive demodulator 624. The output of demodulator 624 is a DC voltage, the amplitude and polarity of which defines the magnitude and direction respectively of the position error. The error signal is outputed by demodulator 624 as a DC voltage on demodulator output line 637 and is detected by excess error detector 603. Excess error detector 603 shuts down the servo system if the racker assembly should not track the programmed position accurately. Demodulator output line 637 also feeds the DC error voltage to gain adjust network 625. Gain adjust network 625 comprises parallel potentiometers 656 and 657 and sets the loop gain for upper racker servo system 600. Parallel potentiometers are required since the inertia of arm drive 642 differs from the inertia of carriage drive 644, and one setting of the loop gain would not provide the proper servo system response for both arm and carriage control. The loop gain is the product of the gains encountered in forming the loop which comprises the feedback path and the feed-forward path. The gain is a factor in the servo system's closed loop transfer function which describes the servo system response. Carriage gain select relay 635 connects carriage gain adjust potentiometer 657 into the control system when carriage drive 644 is being controlled. Arm gain select relay 636 connects arm gain adjust potentiometer 656 into the control system when arm drive 642 is being controlled. DC amplifier 626 then receives the DC error signal from network 625 and the output of tachometer 615 or 605 depending upon the particular axis selected. DC amplifier 626 produces a compensating output signal to reduce the error in position as reflected by the D-S converter output. The output of tachometer 615 (or 605) is fed into DC amplifier 626 to provide loop damping compensation for stabilizing the servo system. DC servo controller 602 may be implemented by a Moog MWOG82E453 controller in a manner well known to those skilled in the art.

In operation, racker servo system 600 controls the movement of carriage drive 644 and arm drive 642 alternately in response to the commands of controller 235. Energizing the carriage select relay 646 together with gain adjust relay 635 connects the feedback sensor apparatus into the closed loop of the servo system. Arm select relay 648 and arm gain adjust relay 637 operates similarly. The closure of the selected relay also energizes the corresponding solenoid valve 631 or 632. The energized solenoid valve, 631 or 632, serves to connect servo valve 630 to the correct hydraulic motor, for the motion desired. Servo valve 630 receives the electrical output signal of DC servo controller 602 and varies the hydraulic fluid supplied to the selected hydraulic motor to effect arm or carriage motion. Servo valve 630 may be implemented by a Moog No. 72-102 servo-valve in a conventional manner. Hydraulic motors 633 and 634 could be Staffa type B80 reversible variable flow hydraulic motors. During operation it is desirable to move the carriage assembly along only one axis at any given time. Racker motion detector 628, as previously described, prevents transfer of drive mechanisms from one axis to another until the velocity of the drive mechanism presently under control is near zero as indicated by a near zero tachometer output voltage.

A similar servo system to that just described may be used to control the movement of the intermediate and lower racker assemblies, their presence depending upon the particular embodiment. Controller 235 would have similar inputs and outputs, as described above in the description of upper racker servo system, extending to the remaining racker servo systems.

HYDRAULIC CONTROLS

Figure 10B:
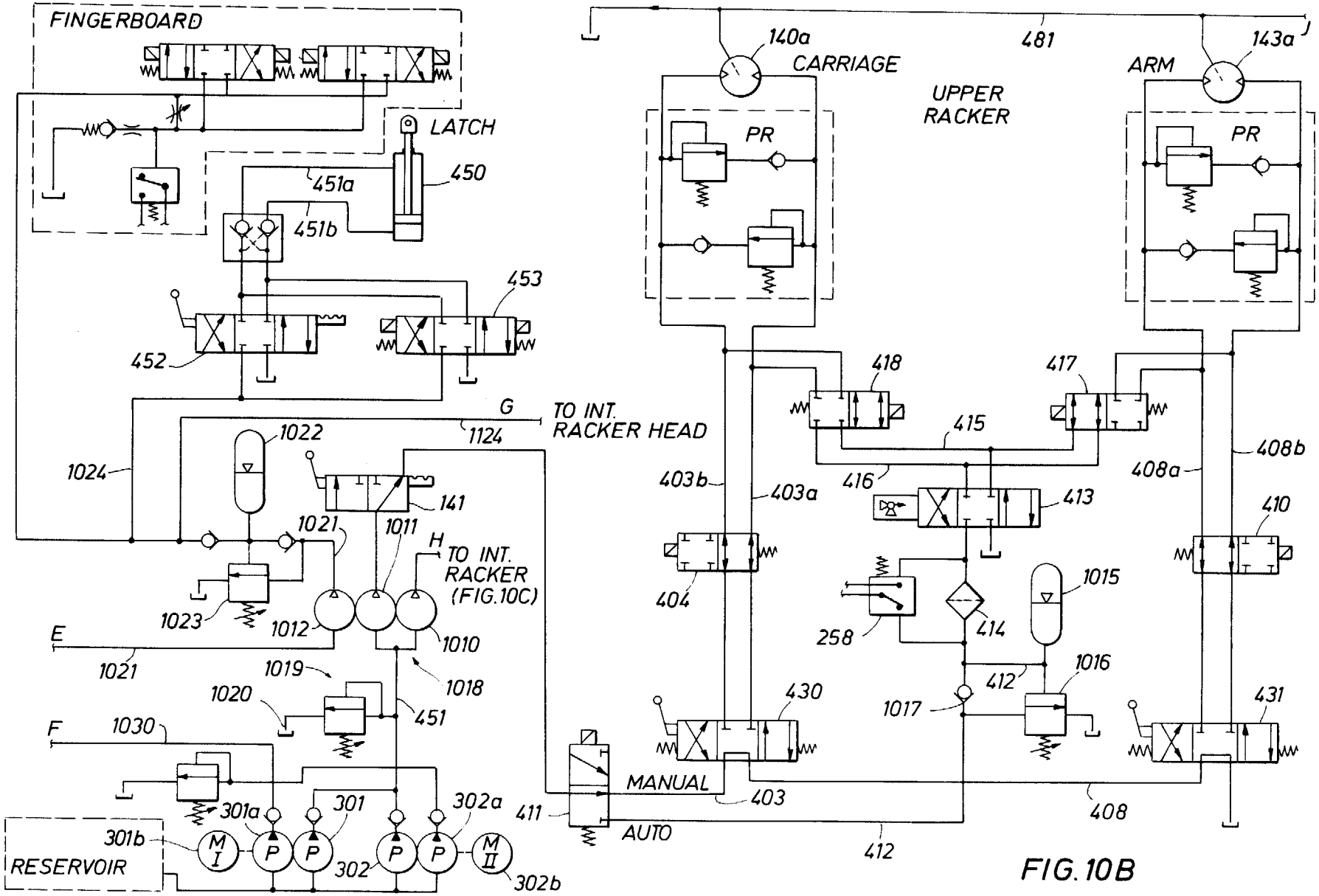
Figure 10C:
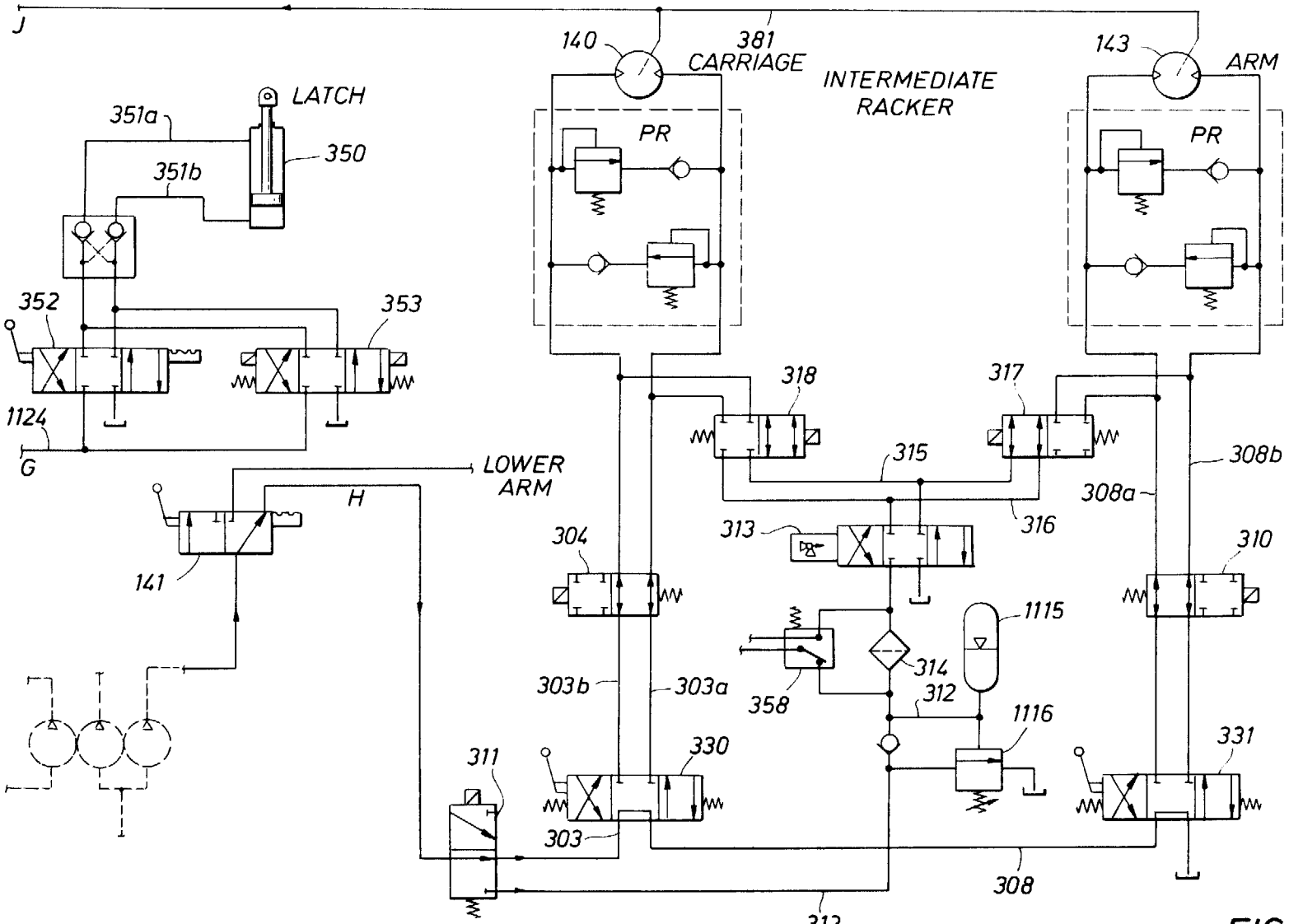

Referring to FIGS. 10A, 10B and 10C, there is shown in schematic form, the piping and hydraulic control system of the present invention. The motor means for actuation of the respective racker arms are adapted to be supplied with fluid under pressure from a pump or series of pumps and reservoir which may be suitable located beneath the derrick floor. Such a reservoir is generally illustrated at 300, the reservoir being adapted to supply fluid to and receive fluid from the hydraulic systems for supplying fluid to the pumps 301 and 302 which in turn supply pressurized fluid to the motors for effecting actuation of the intermediate racker assembly, on the one hand, and the upper and lower racker assemblies, if present in the particular embodiment, on the other hand. In these systems, carriage motors 140 and **140*a* and racker arm motors 143 and 143*a* of the respective racker assemblies are adapted to receive pressurized fluid from a positive displacement pump denoted at 301.**

A similar pump 302 is adapted to supply pressurized fluid to the same racker assembly motors, although both pumps do not operate simultaneously. Through suitable pressure relief mechanisms, both pumps could be utilized simultaneously, however, in this preferred embodiment one pump does not function unless its corresponding pump, which is connected in parallel, becomes inoperative. As indicated in FIG. 10B, there are provided two motors 301B and 302B, for driving the hydraulic gear pumps, 301, 301A, 302, 302A. Hydraulic pumps 301A and 302A are connected in parallel as previously mentioned, with only one pump operative at any one time. Pumps 301A and 302A supply pressurized fluid to the lifting head cylinder motor and block retractor (not shown), the upper and intermediate claws, and the finger board. Hydraulic pumps 301 and 302 being similarly connected in parallel, with only one of the two pumps operative at a given time, supply pressurized fluid to the upper and intermediate racker assemblies. In the embodiment of FIGS. 10A, 10B and 10C, the upper and lower carriages are served by one hydraulic fluid source, the particular carriage being selected through directional control valve 141. Since the upper and lower carriages would rarely be used simultaneously, the directional control valve 141 is provided to channel pressure to the desired carriage, thereby effecting a net saving in the amount of hydraulic fluid power apparatus required.

The carriage drive motors 140 and **140*a* for effecting lateral translations of the carriages of the respective rackers are reversible motors, of a positive displacement type, operable in opposite directions depending upon the direction of flow of pressurized fluid thereto and, likewise, the arm drive motors 143 and 143*a* are the same reversible and positive displacement type so that the supply of fluid from the pumps 301 or 301*a* will effect reversal of the motors under the control of selectively operable valve means. The maximum speed of the motors in the manual mode of operation is a function of the volume displaced by the pumps 301 or 302.**

The hydraulic system will be explained with reference primarily to the upper racker assembly as illustrated in FIG. 10B. It is understood that in those embodiments having intermediate and upper racker assemblies, there generally will be a valve in the intermediate racker hydraulics corresponding to the value in the upper racker hydraulics. Both valves will be indicated with the valve associated with the upper racker hydraulics in parentheses, e.g., 304 (404) refers to valve 304 in the intermediate racker system and valve 404 in the upper racker system, both valves performing similar functions.

As previously mentioned, the pumps 301A and 302A, supplying pressurized fluid to the lifting head, upper and intermediate claws, and finger board, are connected in parallel, although only one pump will be operative at any one time. Similarly, pumps 301 and 302, supplying pressurized fluid to the upper and intermediate rackers are connected in parallel, with only one pump operative at a given time. However, it is understood, that the pumps could be arranged with suitable pressure relief mechanisms for operating all pumps at all times.

Referring to the upper racker section of FIG. 10B, and the intermediate racker system of FIG. 10C, pumps 301 and 302 supply pressurized fluid to the upper and intermediate racker sections through line 451, which delivers the pressurized fluid to the flow divider apparatus indicated generally at 1018. Prior to reaching the flow divider, there is provided a suitable pressure relief apparatus indicated generally at 1019, which drains to the reservoir 300 through appropriate piping. The drain 1020 and all other drains of similar configuration, communicate directly with reservoir 300. Flow divider 1018 is comprised of three elements, 1010, 1011 and 1012. Element 1010 delivers pressurized fluid to the intermediate racker, with element 1011 delivering pressurized fluid to the upper or lower racker. Elements 1010, 1011 and 1012 are gearably connected such that the pressurized fluid appearing in line 451, and driving flow dividers 1010 and 1011 will, through appropriate mechanical gear linkages, drive element 1012. Element 1012 will be more particularly described hereinafter with reference to the finger board and claw assemblies.

Referring to the upper racker section of FIG. 10B, and the intermediate racker section of FIG. 10C, pump 301, 301A, 302 and 302A supply fluid to the intermediate and upper racker carriage motors 140 (140A) when operating in the manual mode through conduit 303 (403), this being normally opened but being closed when energized. Valve 304 when opened allows the flow of fluid through conduits 303 (403) in either direction so as to effect or reverse operation of the motor 140 (140A). Reversal of the flow of fluid in conduits 303 (403) is accomplished through orifice control valve 330 (430). Valve 330 (430) may be used to control the quantity of flow of pressurized fluid delivered to conduits 303 as well as reversing the flow of pressurized fluid from conduit 303A (403A) to conduit 303B (403B). This reversal of pressurized fluid in conduits 303 (403) accomplishes the reversal of motor 140 (140A), when under manual control.

Similarly, orifice valve 331 (431) is supplied with pressurized fluid through conduit 308 (408). As previously explained there will be movement along only one axis of each carriage assembly at any one time. Thus, only one of the motors 140 and 143 will be operative at a time. Of course, the corresponding motor of the upper carriage will be operative at the same time as that of the intermediate racker. To accomplish this function, there is provided a loop through tandem center valve 330 (430) for directing fluid to valve 331 (431) when it is desired to operate motor 143 (143A). Valve 331 (431) serves a similar function to that of valve 330 (430) in that there is both provision for controlling the rate of flow as well as reversing the direction of flow of pressurized fluid from conduit 308A (408A) to 308B (408B). This reversal of the supplying of pressurized fluid to conduits 308 (408) functions to reverse the flow of fluid through arm motor 143 (143A), thereby reversing the direction of movement of the racker arm. Additionally, in the conduit lines 308 (408), there is a solenoid valve 310 (410) which is normally open in the manual mode of operation of the pipe handling system. These directional control valves 303 (403), 331 (431) contain pressure compensators so that the speed of the drive motors is not effected by loads but is a function of valve spool position only.

In order to select the automatic mode of operation of the pipe handling system, valves 304 (404), 310 (410) and 311 (411) are provided. Upon energizing the solenoid of valve 311 (411) conduit 303 (403) is isolated and the flow of pressurized fluid is directed to conduit 312 (412).

AUTO MODE OPERATION

To operate in the automatic mode, manual/auto interface valves 311 (411), 304 (404) and 310 (410) are all energized. Valves 311 (411) transfers flow from the manual control valve 330 (430) to conduit 311 (412) in order to charge the accumulators 1115 (1015). Valves 304 (404) and 310 (410) close to block flow or leakage through manual control valves 330 (430) and 331 (431).

If it is desired to move the carriage in the automatic mode, X-axis select valve 318 (418) would be opened by energizing its solenoid with a control signal from controller 235. The controller 235 would then generate the appropriate control signal to position servo valve 313 (413), thereby furnishing pressurized fluid at the desired flow rate and in the proper direction to operate carriage drive motor 140 (**140*a*). The direction and speed of carriage drive motor 140 (140*a*) is then controlled by controller 235**.

Similarly, if it is desired to move the racker arm, X-axis select valve 317 (417) would be opened by energizing its solenoid with a control signal from controller 235.

PURPOSES OF AXIS SELECT VALVES

To operate the carriage drive motor 140 (**140*a*) X-axis select valve 318 (418) is opened to connect servo valve 313 (413) to conduits 303 (403) and thereby to carriage drive motor 140 (140*a*). To operate the racker arm drive motor 143 (143*a*) Y-axis select valve 317 (417) is opened to connect servo valve 313 (413) to conduits 308 (408**). It should be noted that the axis select valves permit the use of a single servo valve to operate two or more motors and prevent movement along more than one axis at a time.

When the solenoid of valve 311 (411) is energized in selection of the automatic mode of operation conduit 312 (412) transmits pressurized fluid to servo valve 313 (413) through filter 314 (414), which filter is equiped with a differential pressure sensor 258 (358) to indicate blockage of filter 314 (414) by generating an appropriate feedback signal to controller 235. Further appearing in line 312 (412) is accumulator 1015 (1115) and pressure regulating apparatus 1016 (1116). Accumulator 1015 (1115), being charged with pressurized fluid from line 312 (412) contains a preset pressure set by pressure regulator 1016 (1116), which may also be referred to as an unloading valve. The accumulator, being in close proximity to servo valve 313 (413), supplies pressurized fluid to valve 313 (413) thereby improving the response time of the motors deriving their hydraulic power from valve 313 (413). A further improvement in response time is provided by solenoid valves 304 (404) and 310 (410) which close when energized in the automatic mode and block the flow of fluid from servo valve 313

(413) through manual control valves 303 (403) and 310 (410). Servo valve 313 (413) is a bi-directional flow control valve actuated by a proportional electrical signal adapted to control the precise amounts and directions of flow of pressurized fluid through either of the axis select valves 317 (417) and 318 (418). Axis select valves 317 (417) and 318 (418) are normally closed solenoid valves, being moved to the full open position only upon receiving a command signal from controller 235 for appropriate operation of either a carriage or a racker arm motor.

With the sections of pipe being stored in the vertical position, it has been determined that a good amount of the work space on the derrick floor is rendered unusable for work operations other than mere pipe storage. It has also been determined that storage of the pipe sections in inclined manner with the lower extremities thereof disposed at a greater distance from the axis of the well bore than the distance of the upper extremities of the pipe sections, such as illustrated in dash lines in FIG. 1, will provide an efficient compromise between use of the derrick floor space for pipe storage and work space. Accordingly, the controller 235 may be programmed to provide an offset between the upper racker arm 51 and the intermediate racker arm 52 along the Y-axis. The computer program logic efficiently permits the flexibility to provide the desired racker arm offset that achieves inclined pipe storage. In the event inclined pipe storage is desired, the upper and intermediate and perhaps also the lower pipe racker mechanisms will be programmed to cause angulated translation of the pipe sections during an initial phase of the movement along the Y-axis, after which the racker mechanisms will transport the pipe sections in the inclined position to the particular storage place therefor in similar manner as discussed above in connection with vertical storage of the pipe sections.

MANUAL MODE OPERATION

Although discussion of the present invention has been directed primarily to the auto-mode operation where translation of the pipe sections is accomplished automatically responsive to a programmed sequence, it is clear from the schematic diagrams, especially FIGS. 10B and 10C, that the various pipe racker operational functions may also be accomplished manually. Each of the orifice control valves 301 (331) of FIG. 10C and 430 (431) of FIG. 10B are connected by way of a simple mechanical linkage to a single manual operating control lever, the lever being shown diagrammatically on each of the control valve diagrams to indicate manual control of the valves as desired. By manually actuating the control lever, selectively in particular directions representing either the X or Y axis, the racker mechanisms can be caused to move in selected directions along either the X or Y axis as desired. A simple mechanical lever movement limiting device which may simply take the form of a simple lever guide may be employed to prevent simultaneous hydraulic energization of the racker mechanisms along both the X and Y axes as this may in some cases be detrimental to controllable racking operations.

If it is desired to move the carriage in the automatic mode of operation, X-axis select valve 318 (418) would be opened upon a signal from controller 235. The controller 235 would then generate the appropriate control signal to position servo valve 313 (413), thereby furnishing pressurized fluid in the desired quantity and direction to carriage motor 140 (140*a* ) for movement of the intermediate and upper carriages. Similarly, Y-axis select valve 317 (417) selects the movement of the racker arm motor, the direction and amount of movement of motor 143 (143*a* ) being controlled by servo valve 313 (413). A dump conduit 381 (481) serves to drain the cases of motors 140, 140*a*, 143 and 143*a* and communicates with hydraulic reservoir 300. Without need of specific illustration herein, it will be understood that the motor systems may include suitable crossover relief valves generally denoted at PR as may be desired or necessary to establish and limit the maximum differential pressure of fluid across the ports of motors 140 (140*a* ) and 143 (143*a* ). These valves, one of which may be associated with each of motors 140 (140*a*) and 143 (143*a*), serve to cushion the motors from abrupt changes in fluid pressure and to prevent conduit damage in the event of a sudden stoppage of a motor.

Also receiving pressurized fluid from pumps 301, 301A, 302 and 302A is latch means 350 (450), the piston 196 being the same as that illustrated in FIG. 5. Latch means 350 is associated with intermediate racker 52, functioning to lock drill pipe 49 (FIG. 1) into the lifting head 152. Supplying pressurized fluid to latch means 350 (450) are the hydraulic pumps 301A and 302A. The pressurized fluid appearing in line 1021 has its pressure increased by pump 1012, which is driven by the flow divider pumps 1011 and 1010. Pressurized fluid to a preselected limit is supplied to accumulator 1022, the pressure in accumulator 1022 being controlled by unloading valve 1023. It will be noted that unloading valve 1023 vents excess fluid to the reservoir 300 through suitable piping. Thus, pressurized fluid appearing in line 1024 (1124) appears at valve 352 (452) and 353 (453). Depending upon whether the system is in its manual automatic mode of operation, valve 352 (452) in the manual mode delivers pressurized fluid to latch means 350 (450) in the proper direction as selected by valve 352 (452). In the automatic mode of operation, solenoid valve 353 (453) likewise delivers pressurized fluid to latch means 350 (450). Valve 353 (453) may be spring centered to the closed position such that a power failure will result in closure of the valve.

Conduit 1021 similarly delivers pressurized fluid to the finger latch actuation system, the automatic functioning of which system has heretofore been described. The mechanical functioning of the finger latch selectors operate generally the same as those described in U.S. Pat. No. 3,615,027 with the manual latch selector being supplemented by suitable electrical circuitry from controller 235 for actuation of individual or multiple latches within the racker board when in the automatic mode of operation.

Referring to FIG. 10A, lifting head operating apparatus is illustrated which may take the form of a hydraulic cylinder motor 67 which is operatively connected by a cable to the lifting head 152. Pressurized fluid is delivered to the cylinder 67 of the lifting head apparatus from pumps 301A or 302A through conduit 1030. In the manual mode of operation, valve 1025, which may be a tandem center valve receives pressurized fluid, and through appropriate selection of the proper position of valve 1025, pressurized fluid is delivered to either conduit 1030A or 1030B, depending upon the direction of movement desired for lifting head 152. In the automatic mode of operation, pressurized fluid is delivered to tandem center solenoid valve 1028, which again, through the appropriate selection of the desired direction of movement of lifting head actuating cylinder 67 delivers pressurized fluid either to conduit 1030A or 1030B. There is further provided in conduit 1030B, a suitable holding valve and pressure relief mechanism 1029, to hold the pipe stand in case of pressure failure. Further associated with valve 1028 is creep control 1027, which is utilized to control the speed of movement of lifting head 152, as for example when the lifting head approaches its limit of intended movement, it may be desirable to slow the motion to a speed somewhat less than that utilized for normal movement.

As previously mentioned, and stated in summary, pressurized fluid is delivered to the lifting head operating cylinder, finger board, and claw assemblies from pump 301A or 302A. The pressurized fluid first is supplied to the hydraulic piping associated with lifting head operating cylinder 67, and then through flow divider 1012 to the finger board and claw assemblies.

It will be understood from the description of the operation of the intermediate and upper carriage and racker arm controls that the intermediate and upper racker arm controls are similar in function. The lower carriage could be automated in a similar fashion to that of the upper and intermediate carriages. The operation of the lower carriage in the manual mode is substantially identical to that described in the aforementioned U.S. Pat. No. 3,615,027.

FINGER LATCH SENSOR CIRCUIT

Figure 6:
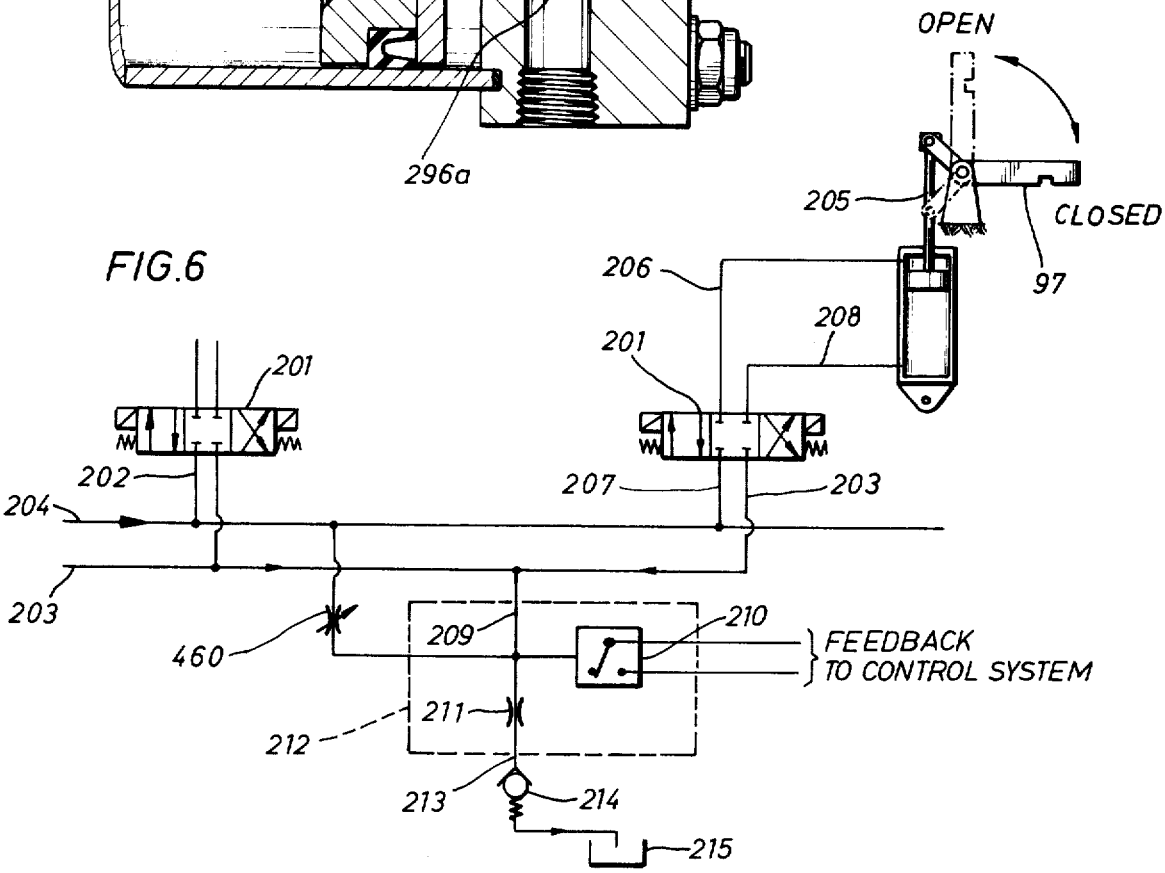
FIG. 6 is a piping schematic of the hydraulic conduits associated with the finger latch control apparatus.

Referring to FIG. 6, there is illustrated a piping schematic depicting two of the hydraulic cylinders 201 which actuate an individual finger latch, such as latch 97 therein depicted. Hydraulic fluid under pressure is supplied to input line 204 thereby supplying each cylinder 201 with pressurized fluid at intake conduits 202 and 206 Upon selectively actuating one of the hydraulic cylinders 201 through electrical circuitry not shown in FIG. 6, for actuation of a finger latch, such as latch 97, the spool of hydraulic valve 201 will be directed to the proper position for supplying hydraulic fluid under pressure to either conduit 206 or 208 depending upon the desired movement of latch 97. For example, if it is desired to move finger latch 97 to the open position the spool of hydraulic valve 201 will move in a direction producing the flow as shown in FIG. 6, thereby aligning conduit 207 with conduit 206, resulting in downward movement of piston 205 and consequent draining of hydraulic fluid through conduit 208 to the tank manifold or drain conduit 203. As hydraulic fluid under pressure is directed through line 208 to the drain conduit 203, there is a consequent rise in pressure in conduit 203 which is communicated to conduit 209 and thence to pressure switch 210. There is provided in the flow sensing apparatus 212 a narrowed orifice 211 for maintaining pressure in the 209 during the actuation of the hydraulic cylinder of the finger latch to insure actuation of switch 210. The orifice, for example, may be sized at approximately 0.050 inches, thereby permitting fluid to drain through orifice 211 at a slow rate, thence through line 213 to check valve 214, and thence to the hydraulic fluid drain line 215. As the piston 205 reaches the limit of its movement, pressure in line 208 necessarily decreases, thereby causing pressure switch 210 to de-activate and be in condition for sensing operation of the next-selected finger.

Additionally, to insure the proper functioning of the pressure sensing apparatus, there is provided fill valve 460 for continuously draining a small amount of pressurized fluid into conduit 209 to insure that conduit 209 does not become contaminated with air. Such contamination would reduce the effectiveness of switch 210 in sensing a pressure rise denoting finger latch actuation.

BLOCK DIAGRAM OF OPERATING SEQUENCE

Referring to FIG. 7, there is shown a simplified block diagram of the typical operating sequence utilized in withdrawing drill string from a well. The drill string may be withdrawn for a variety of reasons, the most typical being the necessity of changing the bit, either by reason of having encountered a different earth formation or for replacing a bit which has become dull through continuous use.

The following description will be given with reference to FIGS. 7 and 1.

At block 220, the rackers illustrated at 51 and 52 of FIG. 1, are in a standby position away from the center line of the well, and generally between well centerline and the side of the derrick. There is a manual operation initially to prepare the drill string for break-out, the operator being required to hoist the block and drill pipe string and set the slips so as to lock the drill string in place and prevent further vertical movement. This position of drill string 49 is illustrated in FIG. 1, the block being lifted through the use of draw works 37 and cables 34. As indicated at block 222, the two rackers move to the center line of the well and the racker claws engage the drill pipe stand. At this point, as indicated at block 223 an additional manual function is performed, in that the joint 18 is broken apart by manual or automatically operated tongs (not shown). Additionally, the elevator 44 is opened, and block 35 retracted adjacent the side of the derrick as shown in FIG. 1 in order to permit removal of stand 49 from its position adjacent the well center line.

As indicated at block 224, the automatic function of the well pipe racking system again is selected, whereby the lifting head 152, as powered by piston and cylinder assembly 67 through cable 66, lifts the stand 49 vertically in order to clear the uppermost end of the drill string 26. Block 225 illustrates the next automatic function whereby the rackets 51 and 52 are driven synchronously to a row position adjacent the finger board 55 (FIG. 3). Next, as indicated at block 226, rackers 51 and 52 are driven synchronously to a column position within one of the spaces 90 of the finger board 55. At block 227, the lift head 152 automatically lowers the stand 49 onto setback 56. At block 228, the appropriate finger latch 97 (FIG. 3) locks the stand 49 in place within finger board 55. At block 229, the claws 152 and 119 open and release the stand 49, with the rackers 51 and 52 returning to a standby position at some midpoint between the side of the derrick and the well center line, as indicated at block 230.

PROGRAMMED SEQUENTIAL OPERATION OF THE DRILL PIPE HANDLING SYSTEM

Figure 18:
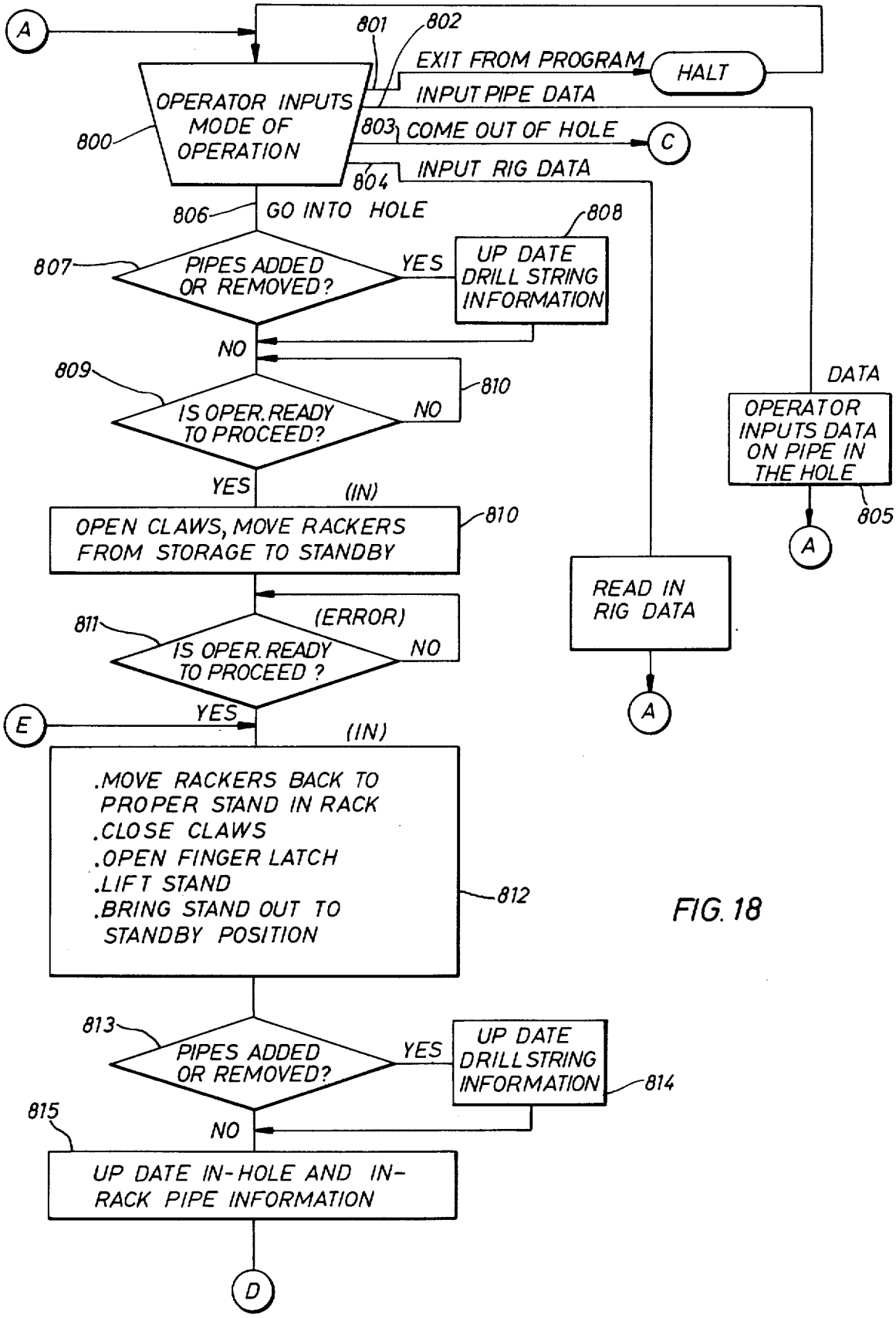
FIGS. 18, 19 and 20 are block views of the sequenced steps of operation associated with the computer program.

Referring to FIG. 18, there is shown a flow diagram, from which a computer program may be derived, which provides in block form the sequence of operation of the automated drill pipe handling system. The initial step in the sequence of programmed instructions occurs at "A". At this point, as indicated by block 800, the operator is required to input the mode of operation. Recalling from FIG. 8, this input may be made by entering information to controller 235 through CRT 236 or through driller's control panel 237. The computer program is a written sequence of instructions which may be coded in binary machine language and contained within the computer memory of controller 235. The operator provides input instructions through CRT 236 in a form to which programmed controller 235 will be responsive. There are five modes of operation which the operator may initiate. As indicated at 801, the operator may input a "halt" signal which causes controller 235 to remain in a standby position; or in the event of the controller 235 being in an execute mode with respect to the program, controller 235 will halt execution of program instructions and enter the standby condition. At 802, the operator may input data concerning the amount and type of pipe within the hole. There are various types of pipe which may make up a drill string, including pipe with rubber protectors, drill collars, and standard drill pipe among others. If the operator chooses this mode of operation, as indicated at block 805 the program sequence returns to position "A" for further instruction after completion of inputting the required data concerning the pipe in the hole.

As indicated at 803, the operator may choose to initiate the sequence in the program whereby drill string is removed from the hole. In the event of this choice, the program proceeds to position "C" for further instructions. The "C" sequence will be explained in detail hereinafter.

The mode of operation indicated at 804 provides for certain rig data to be input to the program within controller 235. This information includes the relative distances between the storage position of the racker system and the well center line, the height of upper and intermediate arm position and the dimensions of the finger board and information defining racker velocity during computer programmed motion.

As indicated at 806, the fifth mode of operation available to the operator is the sequence whereby drill pipe is to be run into the hole. In this sequence, at 807 the operator is queried with respect to whether pipe singles are to be added or removed from the drill string, which would change the data with respect to drill string makeup as programmed into controller 235 at step 802. If the operator indicates there will be a change to the drill string information contained within controller 235, there is provision for updating the information as indicated at block 808. After exit from block 808, the next step in the program sequence, indicated at 809, again queries the operator as to whether he is ready to proceed. If not, loop 810 merely issues another query to the operator concerning his readiness to proceed. As the operator inputs through the keyboard of CRT 236 that he is ready to proceed, a signal is generated to open the claws of the respective rackers. In the embodiment shown in FIG. 1, there may be three or more claws associated with carriage assemblies 51, 52 and 62. Next there is generated a signal to the rackers to move from their storage position adjacent the side of the derrick to a standby position adjacent the rack 55 (FIG. 2). The movement of the rackers is accomplished through the racker servo system, as previously described, and as illustrated in FIG. 9. Essentially, controller 235 selects one of the two axes along which the racker is to be first moved, either the carriage or the arm, then the axis select solenoid valve energizes either hydraulic motor 633 or 634 to accomplish the desired movement.

At this point, the feedback devices previously referred to come into play. The claw open or close sensor 253 (FIG. 8) determines the position of the respective claws through a determination as to the position of switches 288 and 289 of FIG. 15. The in-hole sequence of operation requires that both switches 288 and 289, in those embodiment where there are two claws, be in their closed position to provide a feedback signal to controller 235 thereby permitting the controller to proceed to the next step in the programmed sequence. Again, as indicated at block 811, the operator is queried concerning his readiness to proceed with the removal of pipe stands from the rack. In the event of an affirmative response, the program sequence proceeds to block 812. The rackers are first moved to the proper stand in the rack, again utilizing the racker servo system as illustrated in FIG. 9. The precise position of which the rackers are to move is determined from the rig data as input at controller 235 at sequence 804. Included in the input data was information respecting the number and location of stands within the rack, so the controller may select the proper stand in the rack.

Once the rackers have reached their proper position, the claws of the upper and intermediate arms are closed. Again the electrical circuitry of FIG. 15 comes into play in order to provide a feedback signal to controller 235 that the claws are in fact closed and that it is safe to proceed with the next step in the sequence, that is opening of the proper finger latch. Controller 235 opens the appropriate finger latch, and again requests a feedback signal from the finger latch operate sensor 255 indicating proper functioning of the latch. This feedback signal is provided to controller 235 with the feedback sensor being illustrated at FIG. 6, and heretofore described.

Once the finger latch is open and a feedback signal received confirming the opening, controller 235 issues the next command in the programmed sequence, that being to lift the pipe stand vertically from its position at rest on the derrick floor or setback. After engagement with the pipe stand, the lift head 152 (FIG. 1) is provided with a loading sensor 254 (FIG. 8) which generates another feedback signal to the controller 235 indicating that the pipe stand has been lifted from the setback and is being supported by the racker arms. At this point, controller 235, having received confirmation that the pipe stand is ready for movement, generates the next command in the programmed sequence, as indicated at block 812, that being to raise the stand to a certain height and move the stand out to a predetermined standby position adjacent the rack.

There is provided, as indicated at blocks 813 and 814, another query to the operator concerning the drill pipe stand makeup. As previously indicated, the pipe data was input to controller 235 at sequence 802. If there has been no change from this input data, the sequenced program proceeds to the step indicated at block 815. Block 815 is an automatic function of the sequenced program, and provides for updating of the information respecting the composition and makeup of the pipes that are in hole and the pipes that are in the rack. Just having removed a stand of pipe from the rack, the program automatically stores this information, thereby making provision for moving the rackers to the correct position to locate the next stand of drill pipe. At this point, the program proceeds to sequence "D", which is illustrated in FIG. 20.

Figure 20:
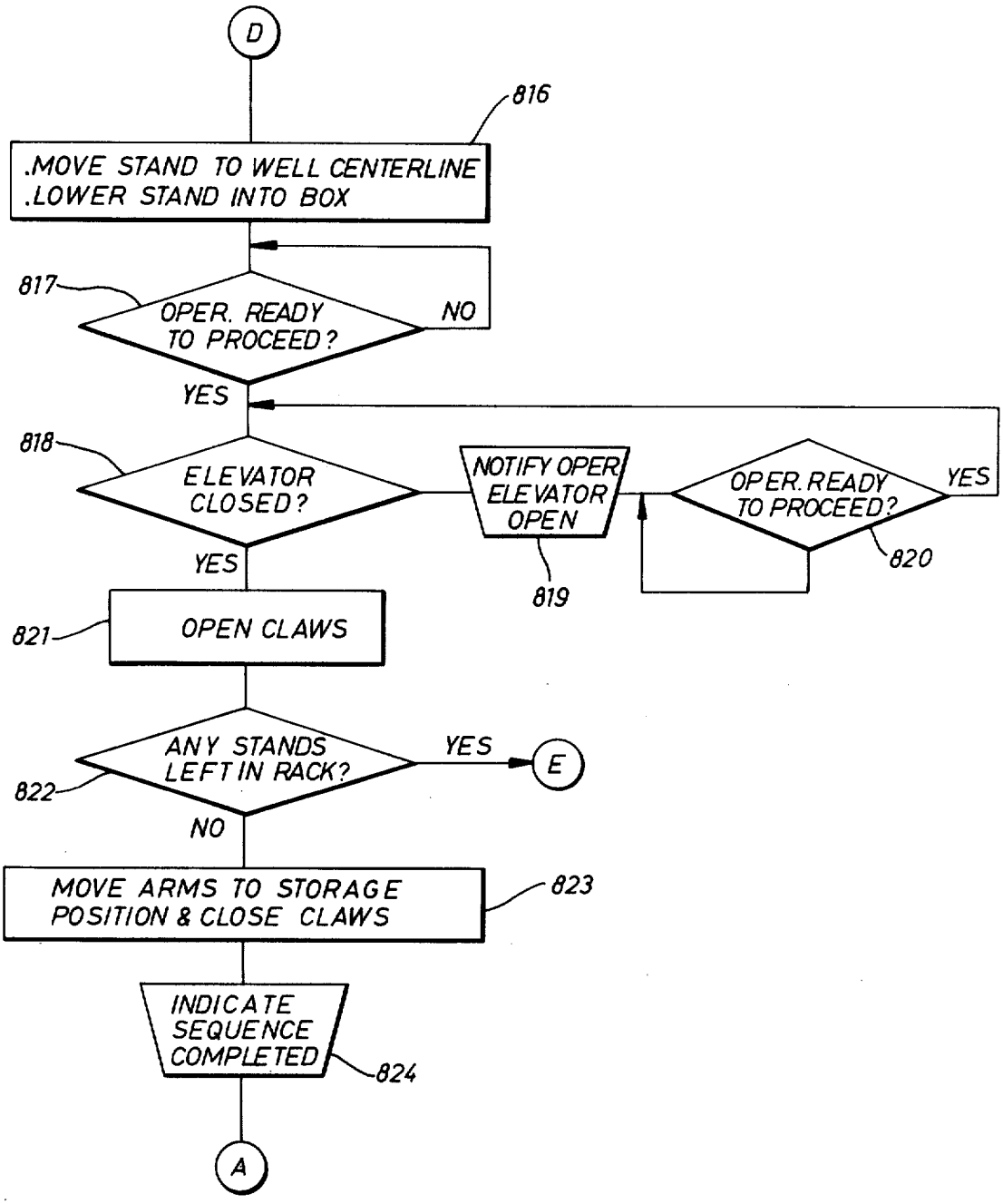

Referring to FIG. 20, the next step in the program sequence of running pipe in hole, is to move the pipe stand to the wall center line as indicated at block 816. Upon reaching the preprogrammed center line position, the lift head lowers the stand into the box (or threaded joint) of the next lower pipe stand. This is illustrated in FIG. 1, where the top of the drill string in the hole is indicated at 26, the pipe being lowered onto drill string 26 being indicated generally at 49. The lifting head 152, through the lifting head load sensor, senses the point in time at which drill pipe stand 49 contacts drill string 26. The load sensor then generates a feedback signal to controller 235 indicating the load is relieved, signifying that pipe stand 49 has contacted drill string 46, with controller 235 then generating a command to stop further vertical movement of lifting head 152.

Prior to moving the stand to the well center line, certain manual functions will have been accomplished, including retraction and hoisting of block 35 adjacent the top of derrick 22, thereby moving it to a position which will not interfere with movement of the stand to the well center line. There is provided a feedback sensor for sensing block retraction, which feedback signal is input to controller 235 to insure clearance at the well center line for the pipe stand being moved into position.

After lowering the stand 49 into the box, there are additional manual functions which must be accomplished prior to proceeding with the automated sequence. These functions include bringing the pipe stand 49 into threaded engagement with drill string 26 and removing the apparatus used to accomplish this function from its position adjacent the tool joint. The block 35 is lowered to position the elevator 44 just below the tool joint. The block is then extended by the operator pushing the "extend" button, with the elevator approaching pipe stand 49 and locking automatically on contact with the drill pipe.

As indicated at block 817, the operator is next queried as to his readiness to proceed. Assuming the joint to be properly made up and the elevator 44 locked into position about pipe stand 49, the operator signals his readiness to proceed through the keyboard of CRT 236 (FIG. 8), or by actuating switch 239 on driller's control panel (FIG. 8B). The controller 235, through its programmed sequence, next queries the feedback sensor associated with elevator 44 to insure the elevator has been locked thereby providing support for the drill string prior to removing the rackers. In the event of the elevator not being locked there will be a control signal as indicated at block 819, provided to the operator indicating a malfunction in the system. After the operator remedies the fault, the system again queries the operator as to his readiness to proceed. In the event of an affirmative response by the operator, the program sequence proceeds to block 818 and queries the feedback associated with elevator 44 (FIG. 2) as to the correct positioning of the elevator lock. Upon receiving an affirmative signal the claws associated with the racker arms are opened (block 821). The information relative to the number of stands remaining in the rack is then determined (block 822). If there are stands remaining, the program proceeds to point "E", and commences the sequence as indicated in FIG. 18. In the event of receiving a negative response from the block 822 query, the operator is provided with visual indication, as, for example through CRT 236 that the sequence is completed, at which point controller 235 issues a command (block 824) to move the arms to their storage position and close the claws.

Referring again to FIG. 18, one of the possible modes of operation that may be selected by the operator at position 800 was the out hole sequence which proceeds to position "C" in the programmed sequence.

Figure 19:
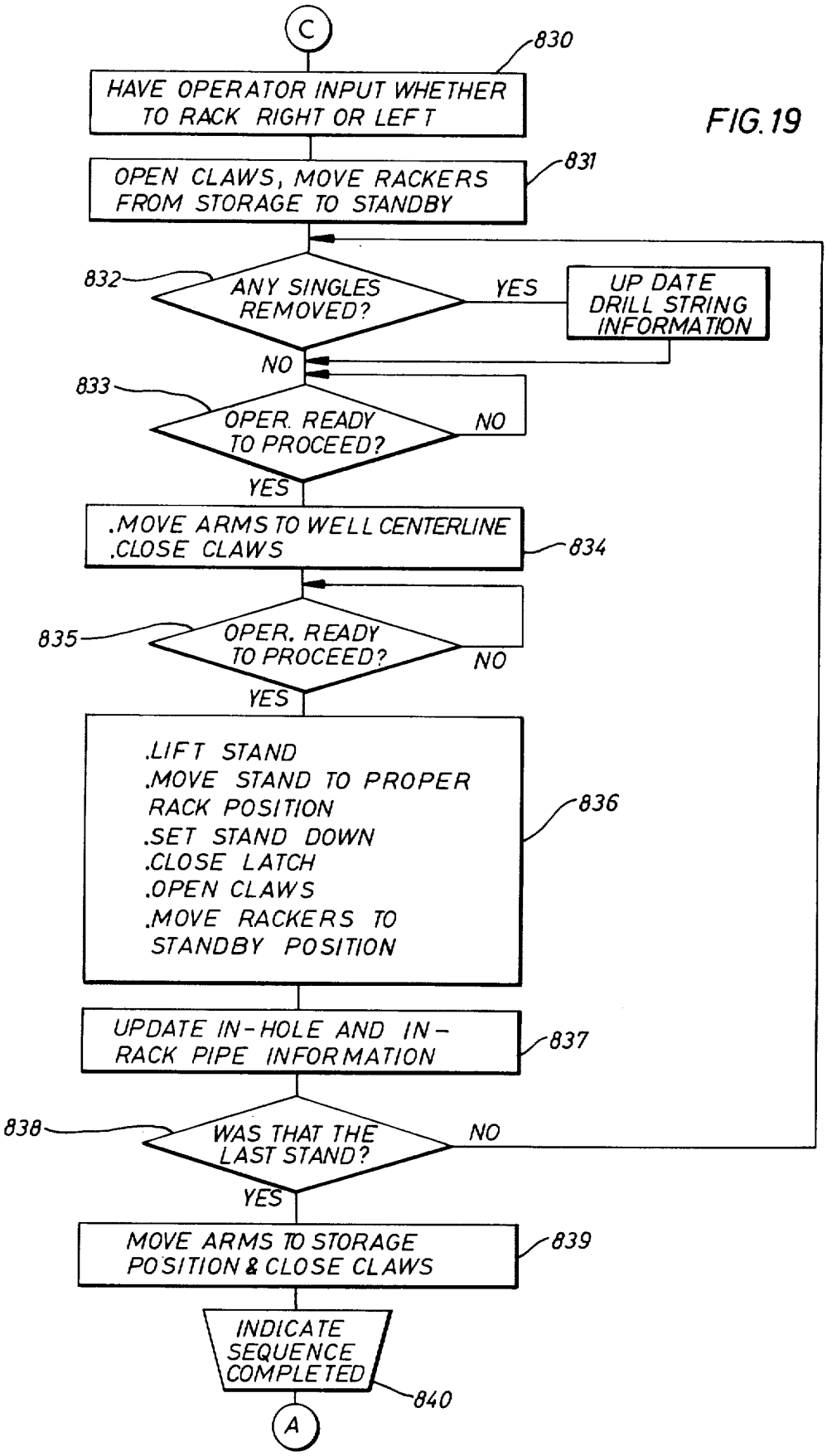

The sequence initiated at position "C" is illustrated in FIG. 19. This sequence is known as the out hole sequence, and is utilized when the operator desires to withdraw the drill string from the hole. As indicated at block 830, the operator must provide an input signal to controller 235 indicating whether the racking sequence is to be commenced in the left hand or the right hand side of rack 55. Upon receiving this input information, controller 235 issues the commands indicated at 831 to open the claws and move the rackers from their storage to their standby position. At this point, there will be stored within the controller 235 the precise makeup of the drill string within the hole. This information includes the number of stands, the type of pipe, and the length of each single or pipe section. At the next step in the programmed sequence at 832, the operator is queried as to whether any pipe singles have been removed or other changes made to the drill string since the information was provided to controller 235. If necessary the operator may then update the drill string information. At 833, the operator is again queried as to his readiness to proceed. Upon receiving an affirmative response, the automated sequence commences (block 834) and the racker arms are moved to the well centerline. The slips 61 will be set in order to prevent drill string 26 from dropping back into the hole after disengaging the pipe stand 49 at the joint 19. The claws are now closed about the pipe stand preparatory for moving it to rack 55. Controller 235 next queries the feedback sensor associated with the respective claws to insure claw closure. At this point, the operator breaks the joint 19, and removes elevator 44 from pipe stand 49, thereby readying pipe stand 49 for vertical movement from the drill string 26. Upon receiving the feedback signal from the feedback assuring claw closure, the operator is queried as to his readiness to proceed (block 835). Checking for block retraction and setting of the slips, the operator signals his readiness to proceed by actuating restart switch 239 on driller's control panel (FIG. 8B). Controller 235 queries the block retracted feedback sensor in order to insure that elevator 44 will be clear of the well center line and therefore clear of pipe stand 49. The automated sequence then continues as indicated at block 836, the first command being to lift the stand away from the drill string 26. Again, controller 235 queries the lifting head load sensor to insure the stand has been lifted from drill string 26 prior to issuing the next commands, that being to raise the lifting head another fixed distance so as to clear the equipment adjacent the top of drill string 26, and to move the stand to its proper rack position. Upon reaching the proper position within rack 55, the stand is set down on the setback platform and a command issued to close the proper finger latch. Controller 235 then queries lift head load sensor to insure the weight has been removed from the lifting head 152. Controller 235 then queries the finger latch sensor to assure proper operation of the finger latches, with the next command to open the claws being then issued. After the claws are open, and a feedback signal confirming this opening received by controller 235, the rackers are moved to their standby position.

At block 837, the information respecting the amount of pipe in the hole and in the racker is updated. At block 838 controller 235 queries the information stored within controller 235 to determine whether the last stand has been removed from the hole. In the event of a negative response, the program sequence recommences at block 832. In the event of an affirmative response, as indicated at block 839, a visual indication is provided the operator on CRT 236 that the sequence has been completed and all pipe removed from the hole. Upon completion of the sequence, the racker arms are moved to a storage position and the claws closed. The program then proceeds to point "A" of the sequence for additional input commands from the operator as indicated in FIG. 18.

From the foregoing, the mode of operation of the present invention will be fully apparent and needs no further description, and, while a specific details of an illustrative embodiment of the invention have been shown and described, changes and alterations may be made without departing from the spirit of the invention as defined in the appended claims.

What is claimed is:

1. A drill pipe handling system for the automated handling of drill pipe lengths, in a well being drilled or otherwise serviced, comprising:

rack means for receiving pipe stands and supporting said pipe stands in spaced apart vertical rows adjacent the side of a derrick, said rack means including a series of parallel rows for receiving said pipe stands and fingers selectively actuable for forming rectangular openings along said parallel rows for locking said pipe stands in place;

sensor means for sensing the individual actuation of said fingers;

racker means for successively moving said drill pipe stands between a position adjacent the center of the derrick and the rack means;

a racker arm extending horizontally from said racker means, said racker arm having a gripping means at the outer end thereof for engaging the drill pipe stands;

computer control means for controlling said rack means, said fingers, said racker means, and said racker arm;

said computer control means including, a programmable general purpose digital computer;

a computer program for providing sequential instructions to said digital computer;

input-output means for monitoring and controlling said digital computer;

said input-output means including, display apparatus for providing visual indication of the status of the computer program and for permitting data or instructions to be input to the digital computer; and a driller's console for permitting control of the drill pipe handling system by inputing instructions to the digital computer, said console including a selector for selecting automated or manual operations of the handling system, and controls and indicator apparatus for starting or stopping the automated function of the handling system and for providing visual indication of the operating status of the handling system.

2. The drill pipe handling system of claim 1, wherein said sensor means comprises an orificed line and a pressure switch for sensing actuation of each finger and generating a feedback signal to said control means to confirm finger actuation.

3. The drill pipe handling system of claim 1, wherein said racker means comprises:

an upper racker means above said rack means; and an intermediate racker means between said rack means and the base of said derrick.

4. The drill pipe handling system of claim 3, wherein each of said upper and intermediate racker means includes:

a longitudinal extending racker arm;

carriage means supporting said racker arm for longitudinal movement in a horizontal direction between said rack means adjacent the side of the derrick and center of said derrick in proximity to the drill string; and means for supporting said carriage of laterial movements in said derrick for the placing of stands into and the removal of stands from said rack means.

5. The drill pipe handling system of claim 4, wherein the racker arm of said upper racker means includes:

a claw for gripping and releasing successive pipe lengths; and a sensor affixed to said claw for determining the operation of said claw.

6. The drill pipe handling system of claim 4, wherein the racker arm of said intermediate racker means includes:

a claw for gripping and releasing successive pipe lengths;

a lifting head for raising and lowering said claw, thereby raising or lowering the drill pipe stand;

a sensor affixed to said claw for sensing the proper operation of said claw; and position sensing apparatus for determining the positional location of said lifting head with respect to said intermediate racker arm.

7. The drill pipe handling system according to claim 4, said racker means further comprising:

a lifting head affixed to a first end of said longitudinally extending racker arm, said first end being adjacent the well center line, said lifting head adapted to lift a drill pipe; and a lifting head position sensor for ascertaining the vertical displacement and position of said lifting head and providing an electrical signal to said computer control means indicative of said displacement and position.

8. The drill pipe handling system according to claim 4, said racker means further comprising:

a lifting head affixed to a first end of said longitudinally extending racker arm, said first end being adjacent the well centerline, said lifting head adapted to lift a drill pipe; and a lifting head load sensor for ascertaining the loaded or unloaded condition of said lifting head and providing an electrical signal to said computer control means indicative of said condition.

9. The drill pipe handling system of claim 4, said racker means including transducer sensor means for sensing translational movement of said carriage means and said longitudinally extending racker arm.

10. The drill pipe handling system of claim 4, said transducer sensor means including:

a plurality of transducer sensors for sensing the position of said racker arm with respect to the well center line and the position of said carriage with respect to the rack means; and velocity sensing apparatus for sensing the velocity of said racker arm and said carriage.

11. The drill pipe handling system of claim 4, wherein the racker arm of said upper racket means includes:

a claw for gripping and releasing successive pipe lengths; and a sensor affixed to said claw for determining the proper operation of said claw.

12. The drill pipe handling system of claim 4, wherein the racker arm of said intermediate racker means includes:

a claw for gripping and releasing successive pipe lengths;

a lifting head for raising and lowering said claw, thereby raising or lowering the drill pipe stand;

a sensor affixed to said claw for sensing the proper operation of said claw; and a position sensing transducer for sensing movement of said lifting head.

13. The drill handling system of claim 1, wherein said computer control means includes a plurality of feedback sensors for providing feedback signals to said digital computer.

14. The drill pipe handling system of claim 1, including:

a traveling block for raising and lowering said pipe stands;

an elevator attached to the traveling block, said elevator being adapted to support a length of drill string; and sensor means affixed to said elevator for determining the closure of said elevator about a length of drill string.

15. The drill pipe handling system of claim 1, wherein said sensor means comprises a proximity switch.

16. A drill pipe handling system as recited in claim 1, wherein said system includes:

manually operated means for controlling said rack means, said fingers, said racker means and said racker arm.

17. A drill pipe handling system as recited in claim 16, wherein:

a hydraulic control system is provided for controlling said rack means, said fingers, said racker means and said racker arm; and said manually operated means comprises valve means in said hydraulic control system, said valve means having a manual mode.

18. A drill pipe handling system as recited in claim 16, wherein:

a hydraulic control system is provided for controlling said rack means, said fingers, said racker means and said racker arm; and auto/manual valve means is provided in said hydraulic control system and has both automatic and manual modes, said auto/manual valve means being selectively operable in either of the automatic or manual modes thereof.

19. A drill pipe handling system as recited in claim 18, wherein:

said auto/manual valve means comprises a plurality of valves that are operably interconnected for simultaneous actuation for achieving movement of said racker means along a first axis and a plurality of valves that are operably interconnected for simultaneous actuation for achieving movement of said racker means along a second axis;

automatic selector means for preventing simultaneous actuation of the valves controlling movement of said racker means along both said first and second axes; and manual selector means for preventing simultaneous actuation of the valves controlling movement of said racker means along both said first and second axes.

20. A drill pipe handling system as recited in claim 1, wherein:

said computer control means causes translational movement of said pipe stands, with said pipe stands being disposed in the generally vertical position thereof.

21. A drill pipe handling system as recited in claim 1, wherein:

said computer control means during movement of said pipe stands from the well center line to the pipe storage rack, causes initial translational movement of said pipe stands from the generally vertical position thereof to a position that is inclined relative to the vertical and causes further translational movement with said pipe stands being maintained in said inclined position during movement to and positioning at said pipe storage rack; and said computer control means, during movement of said pipe stands from said pipe storage rack to the well center line, causes initial translational movement of said pipe stands with said pipe stands being maintained in said inclined position and causes further translational movement of said pipe stands from said inclined position to the substantially vertical position thereof.

22. A drill pipe handling system for the automated handling of successive drill pipe lengths in a well being drilled or otherwise serviced, comprising:

rack means for receiving pipe stands and supporting said pipe stands in spaced apart vertical rows adjacent the side of a well drilling derrick;

racker means including, a longitudinally extending racker arm;

carriage means supporting said racker arm for longitudinal movement in a horizontal plane between said rack means adjacent the side of the derrick and the center of said derrick in proximity to a drill string.

means supporting said carriage for lateral movements in said derrick to place stands in and remove stands from said rack means;

a lifting head affixed to a first end of said longitudinally extending racker arm, said first arm being adjacent the well centerline, said lifting head adapted to lift a drill pipe;

a lifting head sensor for ascertaining the vertical displacement and position of said lifting head and providing an electrical signal to a computer control means indicative of said displacement and position; and computer control means for controlling said rack means and said racker means.

23. A drill pipe handling system for the automated handling of successive drill pipe lengths in a well being drilled or otherwise serviced, comprising:

rack means for receiving pipe stands and supporting said pipe stands in spaced apart vertical rows adjacent the side of a well drilling derrick;

said rack means including a series of parallel rows for receiving said pipe stands and fingers selectively actuable for forming rectangular openings along said parallel rows to restrain movement of a pipe stand and including sensor means for sensing the individual actuation of said fingers, said sensor means comprising an orificed line and pressure switch for sensing actuation of each finger in order to generate a feedback signal to a computer control means thereby confirming finger actuation;

racker means for successively moving said drill pipe stands between a position adjacent the center of the derrick and the rack means; and computer control means for controlling said rack means and said racker means.

24. A drill pipe handling system for the automated handling of successive drill pipe lengths in a well being drilled or otherwise serviced, comprising:

rack means for receiving pipe stands and supporting said pipe stands in spaced apart vertical rows adjacent the side of a well drilling derrick;

racker means for successively moving said drill pipe stands between the position adjacent the center of the derrick and the rack means; and computer control means for controlling said rack means and said racker means, said computer control means further comprising, a programmable general purpose digital computer; a computer program for providing sequential instructions to said digital computer; and input-output means for monitoring and controlling said digital computer;

said input-output means further including, display apparatus for providing visual indication of the status of the computer program and for permitting data or instructions to be input to the digital computer; and a driller's console for permitting control of the drill pipe handling system by inputing instructions to the digital computer, said console including a selector for selecting automated or manual operations of the handling system, and controls and indicator apparatus for starting or stopping the automated function of the handling system and for providing visual indication of the operating status of the handling system.

25. A drill pipe handling system for the automated handling of successive drill pipe lengths in a well being drilled or otherwise serviced, comprising:

rack means for receiving pipe stands and supporting said pipe stands in spaced apart vertical rows adjacent the side of a well drilling derrick;

racker means for successively moving said drill pipe stands between a position adjacent the center of the derrick and the rack means;

a traveling block for raising and lowering said pipe stands;

an elevator attached to the traveling block, said elevator being adapted to support a length of drill string;

sensor means comprising a proximity switch affixed to said elevator for determining the closure of said elevator about a length of drill string; and computer control means for controlling said rock means, said racker means, said traveling block and said elevator.

26. A drill pipe handling system for the automated handling of successive drill pipe lengths in a well being drilled or otherwise serviced, comprising:

rack means for receiving pipe stands and supporting said pipe stands in spaced apart vertical rows adjacent the side of a well drilling derrick;

racker means for successively moving said drill pipe stands between a position adjacent the center of the derrick and the rack means, said racker means including, a longitudinally extending racker arm;

carriage means supporting said racker arm for longitudinal movement in a horizontal plane between said rack means adjacent the side of the derrick and the center of said derrick in proximity to a drill string;

means supporting said carriage for lateral movements in said derrick to place stands in and remove stands from said rack means;

a lifting head affixed to a first end of said longitudinally extending racker arm, said first end being adjacent the well centerline, said lifting head adapted to lift a drill pipe;

a lifting head load sensor for ascertaining the loaded or unloaded condition of said lifting head and providing an electrical signal to a computer control means indicative of said condition; and computer control means for controlling said rack means and said racker means.

27. A drill pipe handling system for the automated handling of successive drill pipe lengths in a well being drilled or otherwise serviced, comprising:

rack means for receiving pipe stands and supporting said pipe stands in spaced apart vertical rows adjacent the side of a well drilling derrick;

racker means for successively moving said drill pipe stands between a position adjacent the center of the derrick and the rack means; said racker means including, a longitudinally extending racker arm;

carriage means supporting said racker arm for longitudinal movement in a horizontal plane between said rack means adjacent the side of the derrick and the center of said derrick in proximity to a drill string;

means supporting said carriage for lateral movements in said derrick to place stands in and remove stands from said rack means;

transducer sensor means for sensing translational movement of said carriage means and said longitudinally extending racker arm, said transducer sensor means including a plurality of transducer sensors for sensing the position of said racker arm with respect to the well center line and the position of said carriage with respect to the rack means and velocity sensing apparatus for sensing the velocity of said racker arm and said carriage; and computer control means for controlling said rack means and said racker means.

28. A drill pipe handling system for the automated handling of successive drill pipe lengths in a well being drilled or otherwise serviced, comprising:

rack means for receiving pipe stands and supporting said pipe stands in spaced apart vertical rows adjacent the side of a well drilling derrick;

racker means for successively moving said drill pipe stands between a position adjacent the center of the derrick and the rack means; and computer control means for controlling said rack means and said racker means, said computer control means comprising, a programmable general purpose digital computer;

a computer program for providing sequential instructions to said digital computer;

input-output means for monitoring and controlling said digital computer; and a plurality of feedback sensors for providing feedback signals to said digital computer.

* * * * *